US005269277A

United States Patent [19]

Kuroda et al.

[11] Patent Number: 5,269,277

[45] Date of Patent: Dec. 14, 1993

[54] FAILURE-DETECTING DEVICE AND FAIL-SAFE DEVICE FOR TANK INTERNAL PRESSURE SENSOR OF INTERNAL COMBUSTION ENGINES

[75] Inventors: Shigetaka Kuroda; Kazutomo Sawamura; Masayoshi Yamanaka; Hiroshi Maruyama, all of Wako, Japan

[73] Assignee: Honda Giken Kogyo Kabushiki Kaisha, Tokyo, Japan

[21] Appl. No.: 5,803

[22] Filed: Jan. 19, 1993

[30] Foreign Application Priority Data

Jan. 20, 1992 [JP] Japan ..... 4-028859

[51] Int. Cl.[5] ..... F02M 33/02; F02B 77/00

[52] U.S. Cl. ..... 123/518; 123/198 D

[58] Field of Search ..... 123/516, 518, 519, 520, 123/521, 198 D; 73/118.1; 364/431.03, 431.05

[56] References Cited

U.S. PATENT DOCUMENTS

| | | | |
|---|---|---|---|
| 4,704,685 | 11/1987 | Martinsons et al. | 123/479 |
| 4,780,826 | 10/1988 | Nakano et al. | 123/479 |
| 5,021,071 | 6/1991 | Reddy | 123/518 |
| 5,143,035 | 9/1992 | Kayanuma | 123/520 |
| 5,146,902 | 9/1992 | Cook et al. | 123/518 |
| 5,168,854 | 12/1992 | Hashimoto et al. | 123/425 |
| 5,182,945 | 2/1993 | Setter | 73/118.1 |
| 5,193,512 | 3/1993 | Steinbrenner et al. | 123/198 D |
| 5,195,498 | 3/1993 | Siebler et al. | 123/698 |
| 5,197,442 | 3/1993 | Blumenstock et al. | 123/520 |
| 5,205,263 | 4/1993 | Blumenstock et al. | 123/520 |

*Primary Examiner*—E. Rollins Cross
*Assistant Examiner*—Thomas N. Moulis
*Attorney, Agent, or Firm*—Nikaido, Marmelstein, Murray & Oram

[57] ABSTRACT

A failure-detecting device detects failure of a tank internal pressure sensor for an internal combustion engine. The tank internal pressure sensor is provided in a fuel tank for detecting pressure within the fuel tank. The failure of the tank internal pressure sensor is detected by detecting an amount of variation in an output from the tank internal pressure sensor occurring within a predetermined time period elapses after the start of the engine and determining that the tank internal pressure sensor is abnormal when the amount of variation is below a predetermined value upon the lapse of the predetermined time period. A fail-safe device inhibits abnormality diagnosis of the evaporative emission control system when it is determined that the tank internal pressure sensor is abnormal. A fail-safe device performs a fail-safe action including at least opening a control valve arranged at an air inlet port of a canister for closing and opening the air inlet port, when it is determined that the tank internal pressure sensor is abnormal.

10 Claims, 17 Drawing Sheets

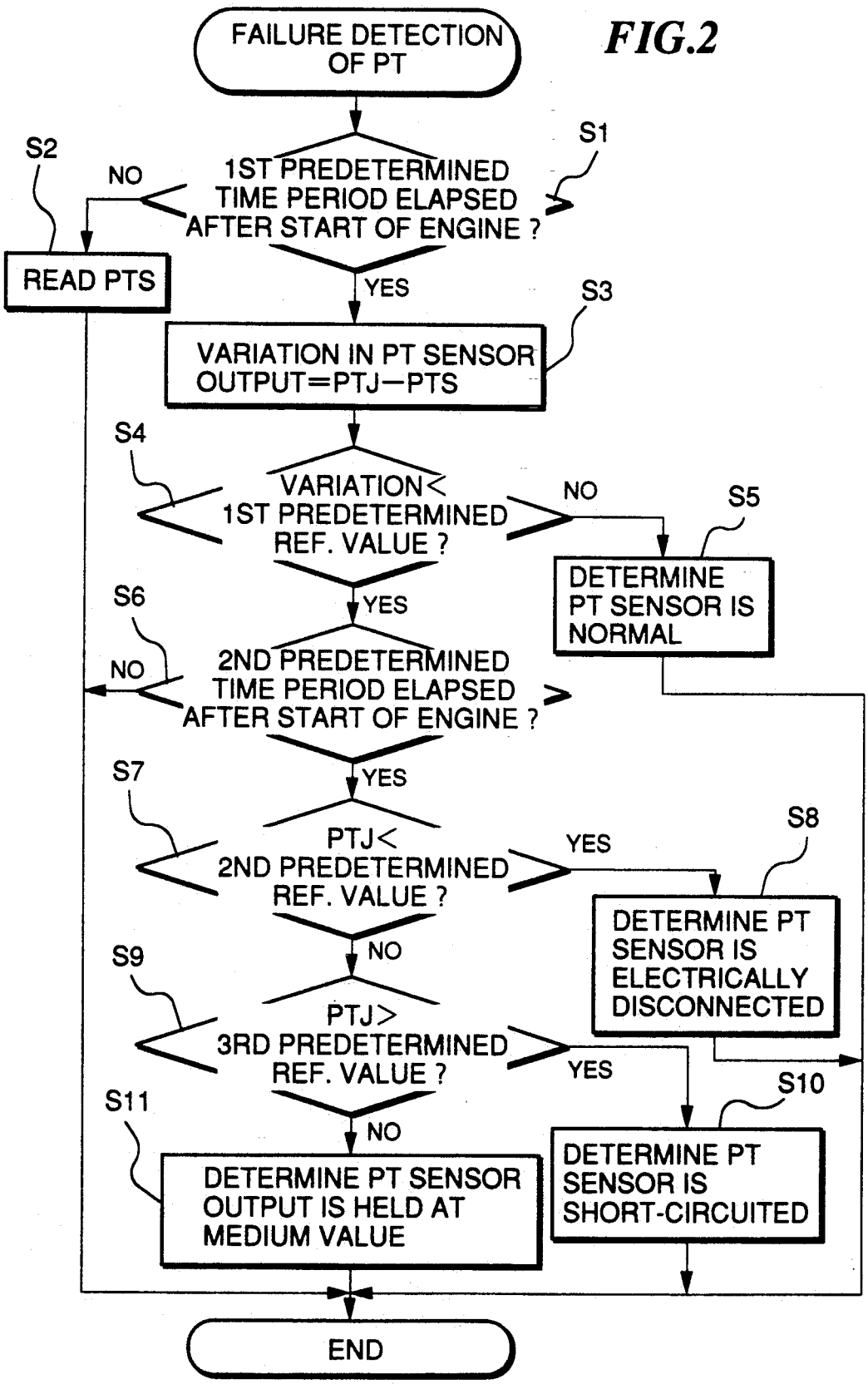
FAILURE DETECTION OF PT
FIG.2
S1
1ST PREDETERMINED TIME PERIOD ELAPSED AFTER START OF ENGINE ?
NO
S2
READ PTS
YES
S3
VARIATION IN PT SENSOR OUTPUT=PTJ−PTS
S4
VARIATION< 1ST PREDETERMINED REF. VALUE ?
NO
S5
DETERMINE PT SENSOR IS NORMAL
YES
S6
2ND PREDETERMINED TIME PERIOD ELAPSED AFTER START OF ENGINE ?
NO
YES
S7
PTJ< 2ND PREDETERMINED REF. VALUE ?
YES
S8
DETERMINE PT SENSOR IS ELECTRICALLY DISCONNECTED
NO
S9
PTJ> 3RD PREDETERMINED REF. VALUE ?
YES
S10
DETERMINE PT SENSOR IS SHORT-CIRCUITED
NO
S11
DETERMINE PT SENSOR OUTPUT IS HELD AT MEDIUM VALUE
END

| FIG.7 | |
|---|---|
| FIG.7a | FIG.7b |

FAILURE-DETECTING DEVICE AND FAIL-SAFE DEVICE FOR TANK INTERNAL PRESSURE SENSOR OF INTERNAL COMBUSTION ENGINES

BACKGROUND OF THE INVENTION

1. Field of the Invention

This invention relates to a failure-detecting device for detecting failure of a tank internal pressure sensor for detecting pressure within a fuel tank of an internal combustion engine, and also to a fail-safe device which performs a fail-safe action when failure of the tank internal pressure sensor has been detected.

2. Prior Art

Conventionally, there has been widely used an evaporative fuel-processing system for internal combustion engines, which comprises a canister having an air inlet port provided therein, a first control valve arranged across an evaporative fuel-guiding passage extending from a fuel tank of an internal combustion engine to the canister, and a second control valve arranged across a purging passage extending from the canister to the intake system of the engine.

A system of this kind temporarily stores evaporative fuel in the canister, and then purges the evaporative fuel into the intake system of the engine.

Whether a system of this kind is normally operating can be checked, for example, by bringing the evaporative emission control system into a predetermined negatively pressurized state, measuring a change in the pressure within the fuel tank (tank internal pressure) with the lapse of time after the evaporating emission control system has been brought into the predetermined negatively pressurized state, and determining whether the system is normally operating, from the measured tank internal pressure, as proposed by U.S. Ser. No. 07/942,875 assigned to the assignee of the present application.

The abnormality-determining system according to the earlier application includes a third control valve provided at the air inlet port of the canister, for closing and opening the same, tank internal pressure-detecting means (tank internal pressure sensor) provided in the fuel tank for detecting pressure within the fuel tank, a first pressure change rate-detecting means for detecting a rate of change in the pressure within the fuel tank by controlling opening and closing of the first control valve, negatively-pressurizing means for setting the evaporative emission control system to a predetermined negatively pressurized state by controlling opening and closing of the first to third control valves when the engine is operating, a second pressure change rate-detecting means for detecting a rate of change in the pressure within the fuel tank by closing the second control valve after the predetermined negatively pressurized state has been established, and abnormality-determining means for determining abnormality of the evaporative emission control system, based upon results of detection by the first and second pressure change rate-detecting means.

According to the above-mentioned abnormality-determining manner, the rate of change in the pressure within the fuel tank detected by the first pressure change rate-detecting means is a rate of change of the pressure in the fuel tank which occurs in the direction toward a positive pressure side (positive pressure side change) due to generation of evaporative fuel within the fuel tank, while the rate of change in the fuel tank pressure detected by the second pressure change rate-detecting means is a rate of change in the fuel tank pressure which starts from a negative pressure state by closing the second control valve, after the evaporative emission control system been brought into the predetermined negatively pressurized state (the pressure within the fuel tank and that within the canister have been made negative) by opening the second control valve (negative pressure side change). The two kinds of pressure change rates detected by the first and second pressure change rate-detecting means are compared with each other to detect an abnormality in the evaporative emission control system (i.e. an amount of evaporative fuel leaking from the system).

However, according to the abnormality-determining manner, in carrying out the negative pressurization of the evaporative emission control system, if the tank internal pressure sensor is faulty, the output from the tank internal pressure sensor does not change irrespective of a change in the pressure within the fuel tank, which may lead to excessive negative pressurization of the evaporative emission control system.

SUMMARY OF THE INVENTION

It is a first object of the invention to provide a failure-detecting device which is capable of accurately detecting failure of a tank internal pressure sensor provided in a fuel tank of an internal combustion engine.

It is a second object of the invention to provide a fail-safe device which performs a proper fail-safe action when failure of the tank internal pressure sensor has been detected.

To attain the first object, according to a first aspect of the invention, there is provided a failure-detecting device for a tank internal pressure sensor for an internal combustion engine having a fuel tank, an intake system, and an evaporative emission control system for controlling purging of evaporative fuel generated in the fuel tank into the intake system, the tank internal pressure sensor being provided in the fuel tank for detecting pressure within the fuel tank.

The failure-detecting device is characterized by comprising:

output variation-detecting means for detecting an amount of variation in an output from the tank internal pressure sensor occurring within a predetermined time period after the start of the engine; and determining means for determining that the tank internal pressure sensor is abnormal when the amount of variation is below a predetermined value upon the lapse of the predetermined time period.

Preferably, the evaporative emission control system includes a canister, a passage connecting the fuel tank with the canister, and a valve arranged across the passage for controlling communication between the fuel tank and the canister, and the valve is opened before the amount of variation in the output from the tank internal pressure sensor is detected, the output variation detecting means detecting the amount of variation in the output from the tank internal pressure sensor after the valve has been closed.

Preferably, the output variation-detecting means comprises first detecting means for detecting a value of the output from the tank internal pressure sensor immediately before a second predetermined time period, which is shorter than the first-mentioned predetermined time period, elapses after the start of the engine, second detecting means for detecting a present value of the output from the tank internal pressure sensor after the second predetermined time period has elapsed and before the first-mentioned predetermined time period elapses, and variation-calculating means for calculating as the amount of variation a difference between the value of the output from the tank internal pressure sensor detected by the first detecting means and the present value thereof detected by the second detecting means.

Also preferably, the failure-detecting device includes means for relieving the pressure within the fuel tank to the atmospheric pressure before detecting the amount of variation in the output from the tank internal pressure sensor.

More preferably, the failure-detecting device includes abnormality kind-determining means for determining a kind of the failure of the tank internal pressure sensor, based on the value of the output detected upon the lapse of the predetermined time period elapses.

To attain the second object, according to a second aspect of the invention, there is provided a fail-safe device for a tank internal pressure sensor for an internal combustion engine having a fuel tank, an intake system, and an evaporative emission control system for controlling purging of evaporative fuel generated in the fuel tank into the intake system, the tank internal pressure sensor being provided in the fuel tank for detecting pressure within the fuel tank.

The fail-safe device according to the second aspect of the invention is characterized by comprising:

output variation detecting means for detecting an amount of variation in an output from the tank internal pressure sensor occurring within a predetermined time period after the start of the engine;

determining means for determining that the tank internal pressure sensor is abnormal when the amount of variation is below a predetermined value upon the lapse of the predetermined time period; and inhibiting means for inhibiting abnormality diagnosis of the evaporative emission control system when the determining means determines that the tank internal pressure sensor is abnormal.

Also to attain the second object, according to a third aspect of the invention, there is provided a fail-safe device for a tank internal pressure sensor for an internal combustion engine having a fuel tank, the tank internal pressure sensor being provided in the fuel tank for detecting pressure within the fuel tank, an intake system, and an evaporative emission control system having a canister having an air inlet port formed therein, an evaporative fuel-guiding passage extending between the fuel tank and the canister, a first control valve arranged across the evaporative fuel-guiding passage for closing and opening the passage, a purging passage extending between the canister and the intake system, a second control valve arranged across the purging passage for closing and opening the purging passage, and a third control valve arranged at the air inlet port of the canister for closing and opening the air inlet port.

The fail-safe device according to the third aspect of the invention is characterized comprising:

output variation-detecting means for detecting an amount of variation in an output from the tank internal pressure sensor occurring within a predetermined time period after the start of the engine;

determining means for determining that the tank internal pressure sensor is abnormal when the amount of variation is below a predetermined value upon the lapse of the predetermined time period; and valve control means for performing a fail-safe action including at least opening the third control valve when the determining means determines that the tank internal pressure sensor is abnormal.

The above and other objects, features, and advantages of the invention will be more apparent from the following detailed description taken in conjunction with the accompanying drawings.

BRIEF DESCRIPTION OF THE DRAWINGS

FIG. 2 is a flowchart of a program for detecting failure of the PT sensor;

DETAILED DESCRIPTION

The invention will now be described in detail with reference to the drawings showing embodiments thereof.

Figure 1:
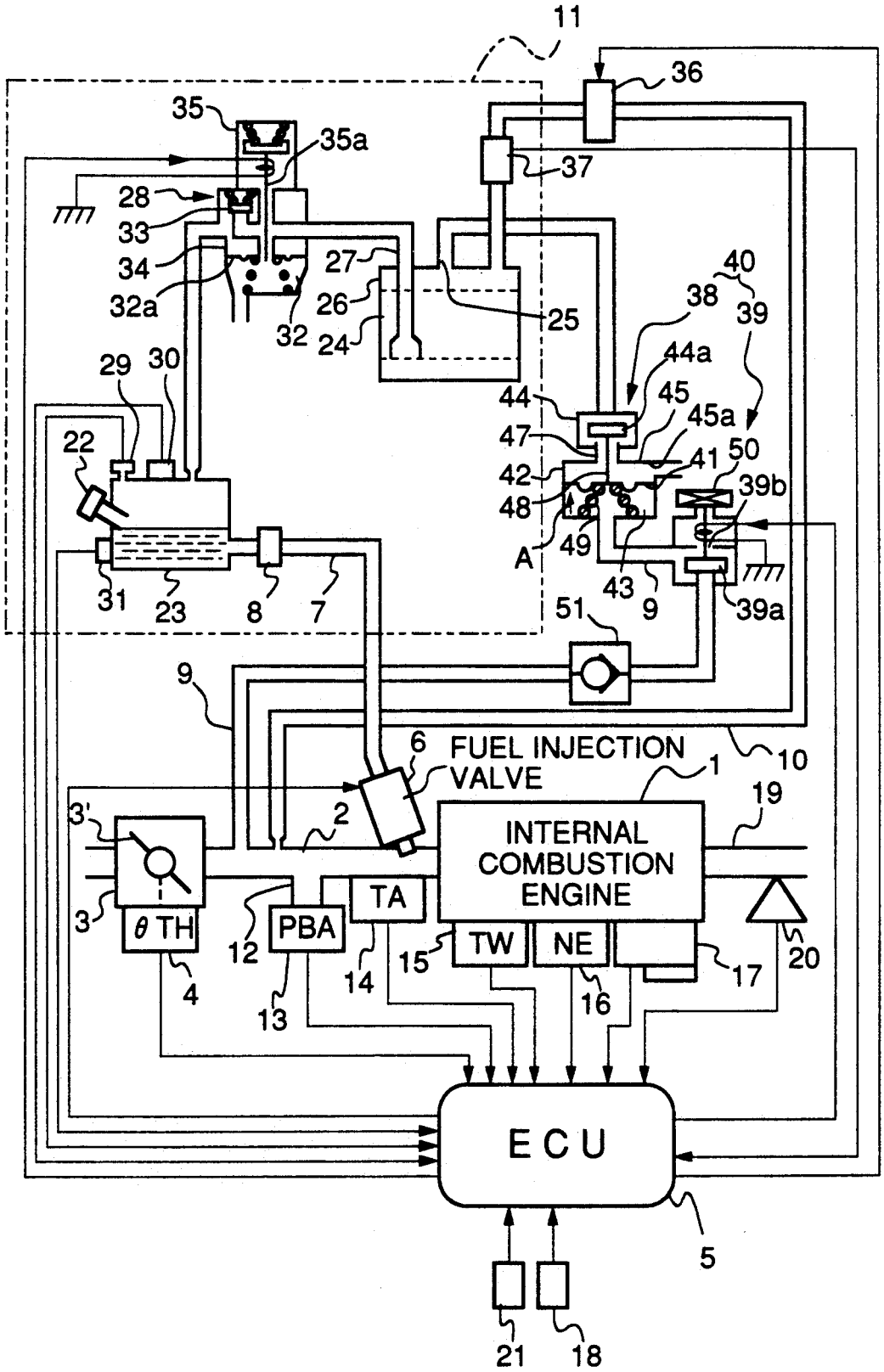
FIG. 1 is a block diagram showing the whole arrangement of an internal combustion engine and an evaporative fuel-processing system therefore, in which is incorporated a failure-detecting device for a tank internal pressure sensor (PT sensor) according to an embodiment of the invention.

Referring first to FIG. 1, there is illustrated the whole arrangement of an internal combustion engine and an evaporative fuel-processing control system therefore, in which are incorporated a failure-detecting device and a fail-safe device for a tank internal pressure sensor according to an embodiment of the invention.

In the figure, reference numeral 1 designates an internal combustion engine (hereinafter simply referred to as "the engine") having four cylinders, not shown, for instance. Connected to the cylinder block of the engine 1 is an intake pipe 2 across which is arranged a throttle body 3 accommodating a throttle valve 3' therein. A throttle valve opening ($\theta$TH) sensor 4 is connected to the throttle valve 3' for generating an electric signal indicative of the sensed throttle valve opening and supplying same to an electronic control unit (hereinafter referred to as "the ECU") 5.

Fuel injection valves 6, only one of which is shown, are inserted into the interior of the intake pipe 2 at locations intermediate between the cylinder block of the engine 1 and the throttle valve 3' and slightly upstream of respective intake valves, not shown. The fuel injection valves 6 are connected to a fuel pump 8 via a fuel supply pipe 7, and electrically connected to the ECU 5 to have their valve opening periods controlled by signals therefrom.

A negative pressure communication passage 9 and a purging passage 10 open into the intake pipe 2 at respective locations downstream of the throttle valve 3', both of which are connected to an evaporative emission control system 11, referred to hereinafter. Further, an intake pipe absolute pressure (PBA) sensor 13 is provided in communication with the interior of the intake pipe 2 via a conduit 12 opening into the intake passage 2 at a location downstream of an end of the purging passage 10 opening into the intake pipe 2, for supplying an electric signal indicative of the sensed absolute pressure PBA within the intake pipe 2 to the ECU 5.

An intake air temperature (TA) sensor 14 is inserted into the intake pipe 2 at a location downstream of the conduit 12, for supplying an electric signal indicative of the sensed intake air temperature TA to the ECU 5.

An engine coolant temperature (TW) sensor 15 formed of a thermistor or the like is inserted into a coolant passage filled with a coolant and formed in the cylinder block, for supplying an electric signal indicative of the sensed engine coolant temperature TW to the ECU 5.

An engine rotational speed (NE) sensor 16 is arranged in facing relation to a camshaft or a crankshaft of the engine 1, neither of which is shown. The engine rotational speed sensor 16 generates a pulse as a TDC signal pulse at each of predetermined crank angles whenever the crankshaft rotates through 180 degrees, the pulse being supplied to the ECU 5.

A transmission 17 is connected between wheels of a vehicle, not shown, and an output shaft of the engine 1, for transmitting power from the engine 1 to the wheels.

A vehicle speed (VSP) sensor 18 is mounted on one of the wheels, for supplying an electric signal indicative of the sensed vehicle speed VSP to the ECU 5.

An oxygen concentration ($O_2$) sensor 20 is inserted into an exhaust pipe 19 extending from the engine 1, for supplying an electric signal indicative of the sensed oxygen concentration to the ECU 5.

An ignition switch (IGSW) sensor 21 detects an ON (or closed) state of an ignition switch IGSW, not shown, to detect that the engine 1 is in operation, and supplies an electric signal indicative of the ON state of the ignition switch IGSW to the ECU5.

A fuel tank 23 having a filler cap 22 which is removed for refueling is provided in the vehicle.

The evaporative emission control system 11 is comprised of a canister 26 containing activated carbon 24 as an adsorbent and having an air inlet port 25 provided in an upper wall thereof, an evaporative fuel-guiding passage 27 connecting between the canister 26 and the fuel tank 23, and a first control valve 28 arranged across the evaporative fuel-guiding passage 27.

The fuel tank 23 is connected to the fuel injection valves 6 via the fuel pump 8 and the fuel supply pipe 7, and has a tank internal pressure (PT) sensor (hereinafter referred to as "the PT sensor") 29 and a fuel amount (FV) sensor 30, both mounted at an upper wall thereof, and a fuel temperature (TF) sensor 31 mounted at a lateral wall thereof. The PT sensor 29, the FV sensor 30, and the TF sensor 31 are electrically connected to the ECU 5. The PT sensor 29 senses the pressure (tank internal pressure PT) within the fuel tank 23 and supplies an electric signal indicative of the sensed tank internal pressure PT to the ECU 5. The FV sensor 30 senses the volumetric amount of fuel within the fuel tank 23 and supplies an electric signal indicative of the sensed volumetric amount of fuel to the ECU 5. The TF sensor 31 senses the temperature of fuel within the fuel tank 23 and supplies an electric signal indicative of the sensed fuel temperature TF to the ECU 5.

The first control valve 28 is comprised of a two-way valve 34 formed of a positive pressure valve 32 and a negative pressure valve 33, and a first electromagnetic valve 35 formed in one body with the two-way valve 34. More specifically, the first electromagnetic valve 35 has a rod **35*a*, a front end of which is fixed to a diaphragm 32*a* of the positive pressure valve 32. Further, the first electromagnetic valve 35 is electrically connected to the ECU 5 to have its operation controlled by a signal supplied from the ECU 5. When the first electromagnetic valve 35 is energized, the positive pressure valve 32 of the two-way valve 34 is forcedly opened to open the first control valve 28, whereas when the first electromagnetic valve 35 is deenergized, the valving (opening/closing) operation of the first control valve 28 is controlled by the two-way valve 34** alone.

A purge control valve (second control valve) 36 is arranged across the purging passage 10 extending from the canister 26, which valve has a solenoid, not shown, electrically connected to the ECU 5. The purge control valve 36 is controlled by a signal supplied from the ECU 5 to linearly change the opening thereof. That is, the ECU 5 supplies a desired amount of control current to the purge control valve 36 to control the opening thereof.

A hot wire-type flowmeter (mass flowmeter) 37 is arranged in the purging passage 10 at a location between the canister 26 and the purge control valve 36. The flowmeter 37 has a platinum wire, not shown, which is heated by an electric current and cooled by a gas flow flowing in the purging passage 10 to have its electrical resistance reduced. The flowmeter 37 has an output characteristic variable in dependence on the concentration and flow rate of evaporative fuel flowing in the purging passage 10 as well as on the flow rate of a mixture of evaporative fuel and air being purged through the purging passage 10. The flowmeter 37 is electrically connected to the ECU 5 for supplying an electric signal indicative of the flow rate of the mixture purged through the purging passage 10.

A drain shut valve 38 is mounted across the negative pressure communication passage 9 connecting between the air inlet port 25 of the canister 26 and the intake pipe 2, and a second electromagnetic valve 39 is mounted across the negative pressure communication passage 9 at a location downstream of the drain shut valve 38, the drain shut valve 38 and the second electromagnetic valve 39 constituting a third control valve 40.

The drain shut valve 38 has an air chamber 42 and a negative pressure chamber 43 defined by a diaphragm 41. Further, the air chamber 42 is formed of a first chamber 44 accommodating a valve element **44*a*, a second chamber 45 formed with an air introducing port 45*a*, and a narrowed communicating passage 47 connecting the second chamber 45 with the first chamber 44. The valve element 44*a* is connected via a rod 48 to the diaphragm 41. The negative pressure chamber 43 communicates with the second electromagnetic valve 39 via the communication passage 9, and has a spring 49 arranged therein for resiliently urging the diaphragm 41 and hence the valve element 44*a*** in the direction indicated by an arrow A.

The second electromagnetic valve 39 is constructed such that when a solenoid thereof is deenergized, a valve element thereof is in a seated position to allow air to be introduced into the negative pressure chamber 43 via an air inlet port 50, and when the solenoid is energized, the valve element is in a lifted position in which the negative pressure chamber 43 communicates with the intake pipe 2 via the communication passage 9. In addition, reference numeral 51 indicates a check valve.

The ECU 5 comprises an input circuit having the functions of shaping the waveforms of input signals from various sensors, shifting the voltage levels of sensor output signals to a predetermined level, converting analog signals from analog-output sensors to digital signals, and so forth, a central processing unit (hereinafter called "the CPU"), memory means storing programs executed by the CPU and for storing results of calculations therefrom, etc., and an output circuit which outputs driving signals to the fuel injection valves 6, the first and second electromagnetic valves 35, 39, and the purge control valve 36.

Figure 3:
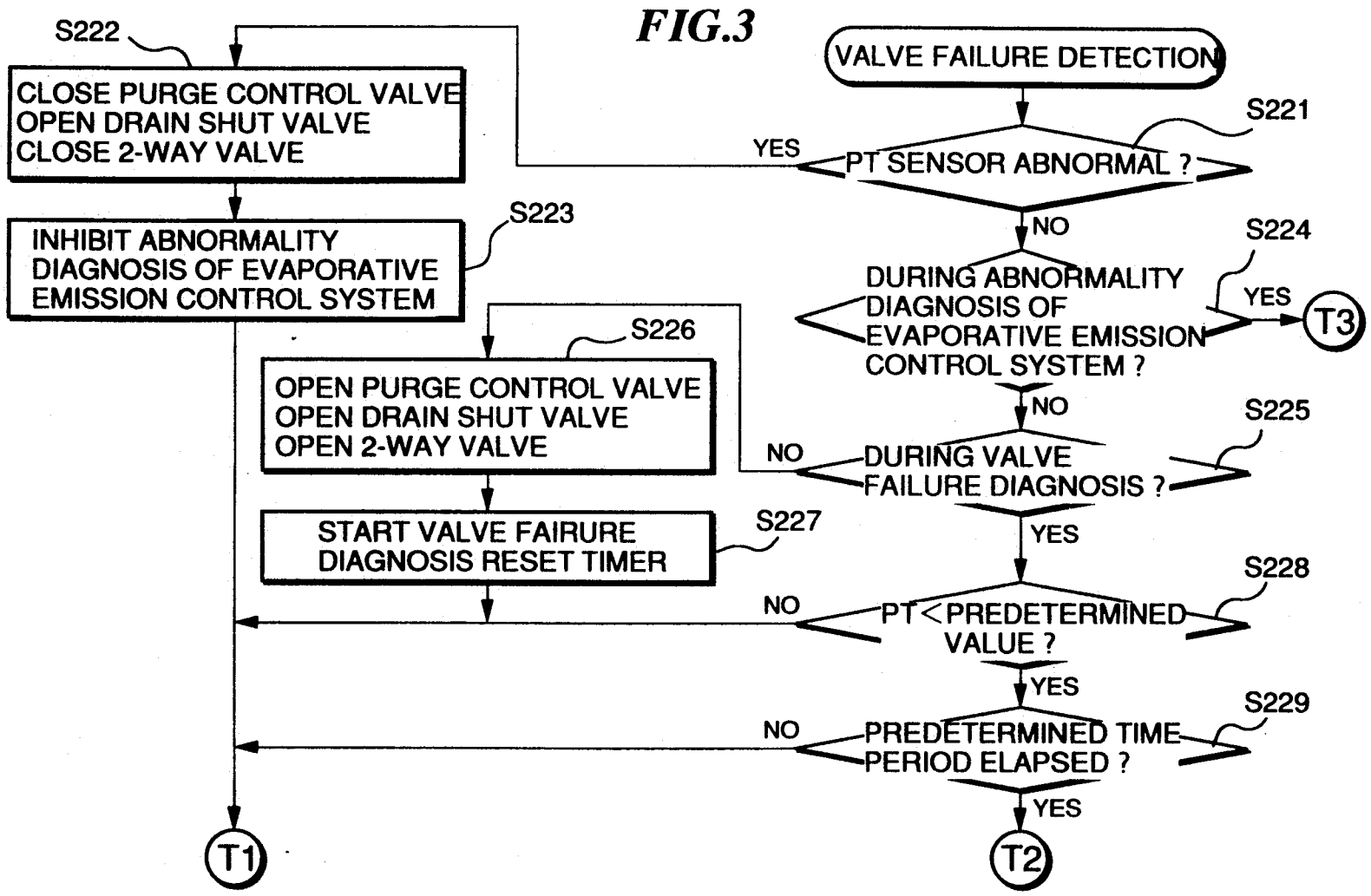
FIG. 3 is a flowchart of a part of a program for detecting failure of control valves provided in an evaporative emission control system appearing in FIG. 1.
Figure 4:
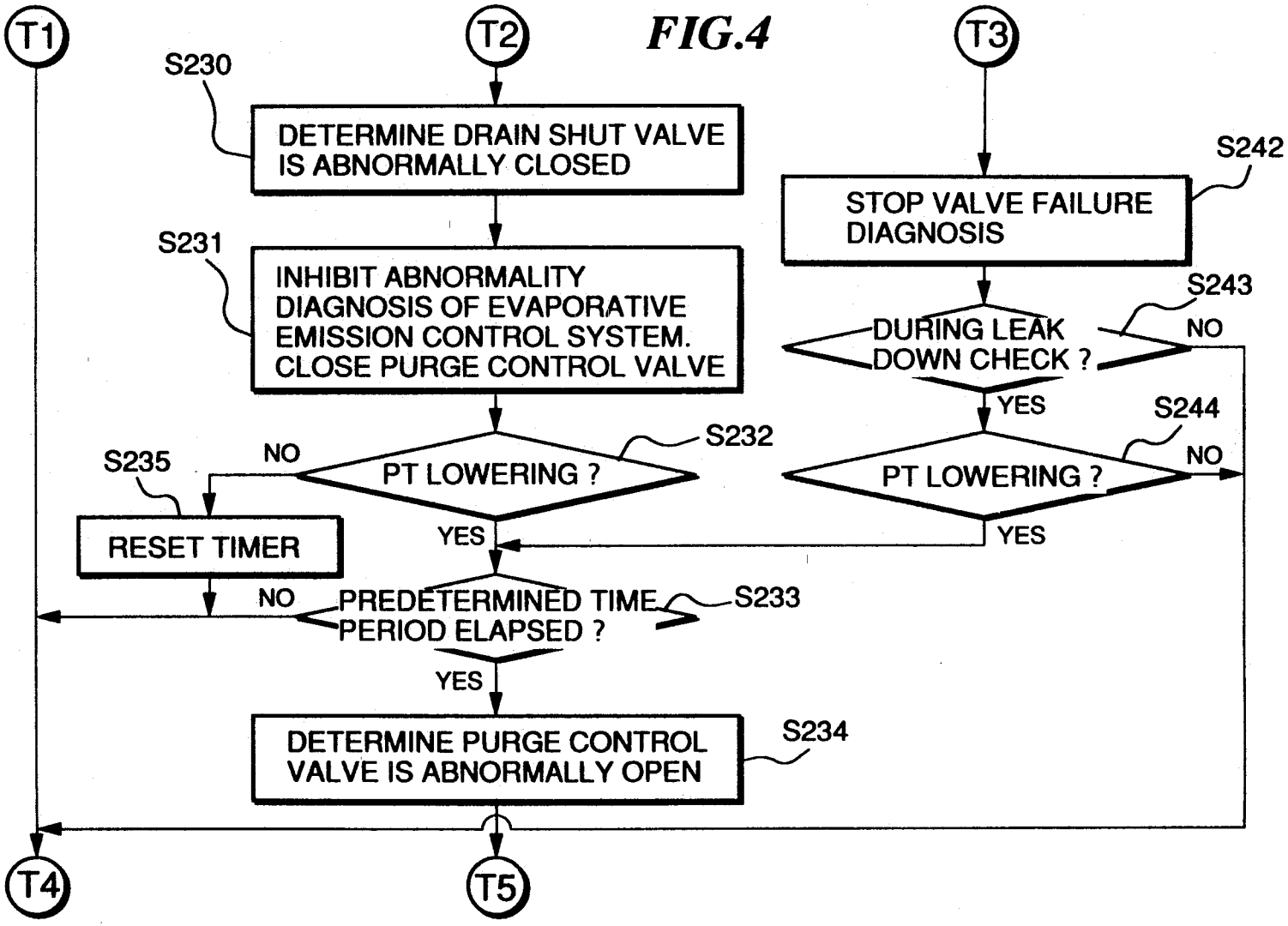
FIG. 4 is a flowchart of another part of the program mentioned above.
Figure 5:
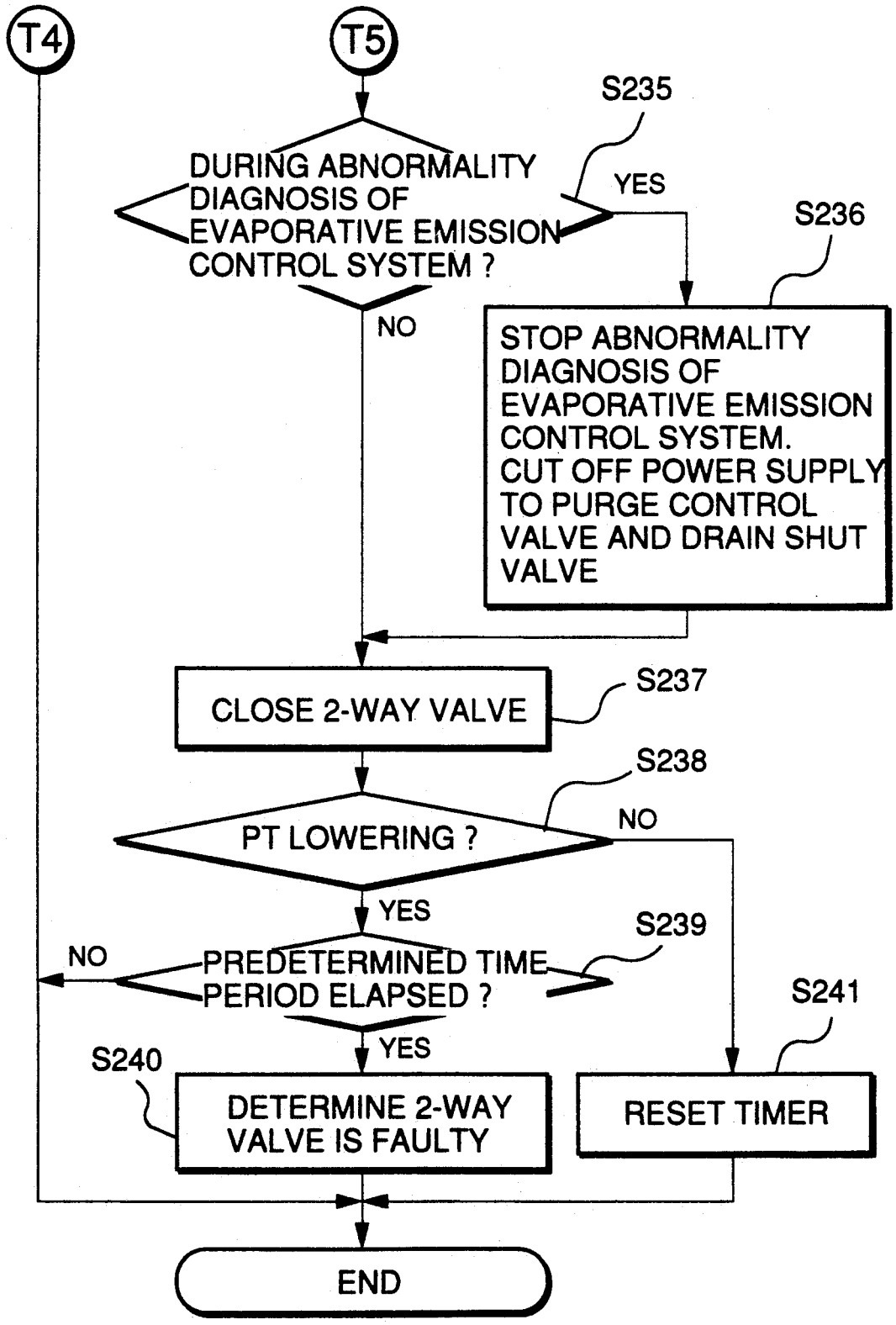
FIG. 5 is a flowchart of a further part of the program mentioned above.

Next, manners of detecting failure of the PT sensor 29, the two-way valve 34, the purge control valve 36 and the drain shut valve 38 of the evaporative fuel emission control system will be described with reference to FIG. 2 to FIG. 5. FIG. 2 shows a program for detecting failure of the PT sensor 29, while FIG. 3 to FIG. 5 show a program for detecting failure of the two-way valve 34, the purge control valve 36, and the drain shut valve 38. FIG. 3 to FIG. 5 are connected to each other bay of connecting points T1 to T5. These programs are executed as background processing.

First, the manner of detecting failure of the PT sensor 29 will be described.

First, at a step S1, it is determined whether or not a first predetermined time period (e.g. 2 sec.) has elapsed after the IGSW was turned on to start the engine. In this connection, by another routine, not shown, the two-way valve 34 is controlled to open simultaneously when the engine is started, to thereby allow evaporation fuel, concentration of which has been increased during stoppage of the engine, to be adsorbed by the canister 26. In addition, the drain shut valve 38 is normally open, and hence by this opening operation of the two-way valve 34 the tank internal pressure is reliened to the atmospheric pressure. This causes the increased tank internal pressure to decrease to a value proportional to the temperature of fuel assumed before the engine has been warmed up. If the answer to this question is negative (NO), the program proceeds to a step S2, wherein the ECU 5 reads an output value PTS from the PT sensor 29 as an initial value thereof, followed by terminating the program, whereas if the answer is affirmative (YES), the program proceeds to a step S3 wherein the ECU 5 reads an output value (present value) PTJ from the PT sensor 29 which is output when the first predetermined time period has just elapsed, and further calculates a difference between the present value PTJ and the initial value PTS read at the step S2 to detect a variation in the output from the PT sensor 29 occurring after the lapse of the first predetermined time period. In this connection, by the other routine mentioned above, the two-way valve 34 is controlled to be closed upon the lapse of the first predetermined time period.

Then, at a step S4, it is determined whether or not the variation in the output from the PT sensor 29 is smaller than a first predetermined reference value (e.g. $\pm 1$ V). If the answer to this question is negative (NO), i.e. if the former is equal to or larger than the latter, it is determined at a step S5 that the PT sensor 29 is normally functioning. If the answer to the question of the step S4 is affirmative (YES), the program proceeds to a step S6, where it is determined whether or not a second predetermined time period (e.g. 5minutes) has elapsed, i.e. whether or not a variation in the output from the PT sensor 29 has exceeded the first predetermined value over the second predetermined time period. If the answer to this question is affirmative (YES), it means that the output from the PT sensor 29, which should normally exhibit a significant variation, has assumed a substantially constant value e.g. for five minutes, and hence it is determined that the PT sensor 29 is in an abnormal state or faulty. That is, the reason for carrying out the failure detection of the PT sensor 29 immediately after the start of the engine is that as the engine is warmed up, the temperature of fuel in the fuel tank rises accordingly to cause an increase in the tank internal pressure.

At the following steps S7 et seq., the kind of failure of the PT sensor 29 is discriminated from the present value PTJ of the output therefrom. At the step S7, it is determined whether or not the present value PTJ is equal to or lower than a second predetermined value (e.g. 0.5 V). If the answer to this question is affirmative (YES), it is determined that there is an electric disconnection in the PT sensor 29 or its wiring. If the present value PTJ is higher than the second predetermined value, the program proceeds to a step S9, wherein it is determined whether or not the present value PTJ is equal to or higher than a third predetermined value (e.g. 4.5 V). If the answer to this question is affirmative (YES), it is determined at a step S10 that there is a short circuit in the PT sensor 29 or its wiring, whereas if the answer is negative (NO), i.e. if the present value PTJ is higher than the second predetermined value but lower than the third predetermined value, it is determined at a step S11 that the output from the PT sensor 29 is held at a medium value e.g. due to clogging of a conduit communicating between the PT sensor 29 and fuel tank 23.

Thus, according to this embodiment of the invention, it is possible to detect three kinds of failure of the PT sensor 29, i.e. disconnection, short circuit, and holding of the output at a medium value.

Next, the manner of detecting failure of the two-way valve 34, the purge control valve 36 and the drain shut valve 38 will be described with reference to FIG. 3 to FIG. 5.

First, at a step S221, it is determined whether or not the PT sensor 29 has been determined to be abnormal by the program described above with reference to FIG. 2. If the answer to this question is affirmative (YES), the program proceeds to a step S222, wherein the purge control valve 36 is closed, the drain shut valve 38 is opened, and further the first electromagnetic valve 35 is turned off to close the two-way valve 34. This allows the negative pressure valve 33 to open when the tank internal pressure is negative, and to thereby relieve the negative pressure within the fuel tank 23 to the atmosphere via the canister 24 and the drain shut valve 38, which makes it possible to prevent the fuel tank 23 from being negatively pressurized to an excessive degree. At the following step S223, a flag is set to a value of 1 for inhibiting the abnormality diagnosis of the evaporative emission control system 11, referred to hereinafter, from being executed.

On the other hand, if it is determined at the step S221 that the PT sensor 29 is normal, it is determined at a step S224 whether or not the abnormality diagnosis of the system 11 is being executed. If the answer to this question is negative (NO), the program proceeds to a step S225, wherein it is determined whether or not valve failure diagnosis is being executed. If the valve failure diagnosis is not being carried out, the program proceeds to a step S226, where the two-way valve 34, the purge control valve 36 and the drain shut valve 38 are all opened, and then at the following step S227, a valve failure diagnosis start timer is reset and started. On the other hand, if it is determined at the step S225 that the valve failure diagnosis is being executed, it is determined at a step S228 whether or not the pressure within the fuel tank 23 is so negative as to assume a value lower than a predetermined value (e.g. −40 mmhg). If it is determined that the pressure is so negative, it is determined at a step S229 whether or not the pressure within the fuel tank 23 has continued to be lower than the predetermined value over a predetermined time period (e.g. 5 sec.). If the answer to the question of the step S229 is affirmative (YES), it is presumed that the drain shut valve 38 is held in the closed position, and hence it is determined at a step S230 that the drain shut valve 38 is faulty. In addition, the determination at the step S229 is carried out by the use of the valve failure diagnosis start timer.

Thus, when the drain shut valve 38 remains closed or faulty, the purge control valve 36 is closed at a step S231 to inhibit purging, thereby preventing the fuel tank 23 from being excessively negatively pressurized. Further, when the drain shut valve 38 is faulty, the above-mentioned flag for inhibiting the abnormality diagnosis of the evaporative emission control system 11 is set to a value of 1, thereby inhibiting the abnormality diagnosis of the system.

Then, it is determined at a step S232 whether or not the pressure within the fuel tank 23 has been lowering after the purge control valve 36 was closed at the step S231. If the tank internal pressure has been lowering, it is determined at a step S233 whether or not the lowering state has continued over a predetermined time period (e.g. 5 sec.). If the answer to the question of the step S233 is affirmative (YES), it is presumed that the purge control valve 36 has been kept open in spite of a closure command from the ECU 5, it is determined at a step 234 that the purge control valve 36 is faulty. Further, when it is determined at the step S232 that the pressure within the fuel tank 23 has not been lowering, a timer for counting the predetermined time period used at the step S233, is reset at a step S235.

Thus, when the drain shut valve 38 is kept closed due to a fault, and further the purge control valve 36 is kept open due to a fault, it is determined at a step S236 in FIG. 5 whether or not the abnormality diagnosis of the evaporative emission control system 11 is being executed. If the answer to this question is affirmative (YES), the abnormality diagnosis is interrupted and the power supply to the purge control valve 36 and the drain shut valve is cut off at a step S237. If the answer to the question of the step S236 is negative (NO), the first electromagnetic valve 35 is turned off at a step S238 to close the two-way valve 34 for the purpose of preventing the fuel tank 23 from being excessively negatively pressurized. Then, at a step S239, it is determined whether or not the tank internal pressure has been lowering after the first electromagnetic valve 35 was turned off at the step S238. If the answer to this question is affirmative (YES), it is determined at a step S240 whether or not the lowering state has continued over a predetermined time period (e.g. 5 sec.). If the answer to this question is affirmative (YES), it is determined at a step S241 that the two-way valve 34 is faulty. In addition, when it is determined at the step S239 that the pressure within the fuel tank 23 has not been lowering, a timer for counting the predetermined time period used at the step S240 is reset at a step S242.

On the other hand, if it is determined at the step S224 in FIG. 3 that the abnormality diagnosis of the evaporative emission control system 11 is being executed, a flag is set to a value of 1 for inhibiting the valve failure diagnosis described above from being executed. Then at a step S243, it is determined at a step S243 whether or not a leak down check, described hereinafter, in the abnormality diagnosis, is being carried out. If the answer to this question is affirmative (YES), it is determined at a step S244 whether or not the pressure within the fuel tank 23 has been lowering. If the answer to this question is affirmative (YES), the steps S233 et seq. in FIG. 4 are carried out. If either of the answers to the questions of the steps S243 and S244 is negative (NO), the valve failure diagnosis routine is terminated.

Then, operative modes of the two-way valve 34, the purge control valve (second control valve) 36 and the drain shut valve 38 and changes in the tank internal pressure PT resulting therefrom will be described with reference to FIG. 6. In this description, it is assumed that the PT sensor 29, and the above valves associated therewith are normally operating. The operations of the valves are controlled by signals from the ECU 5.

Figure 6:
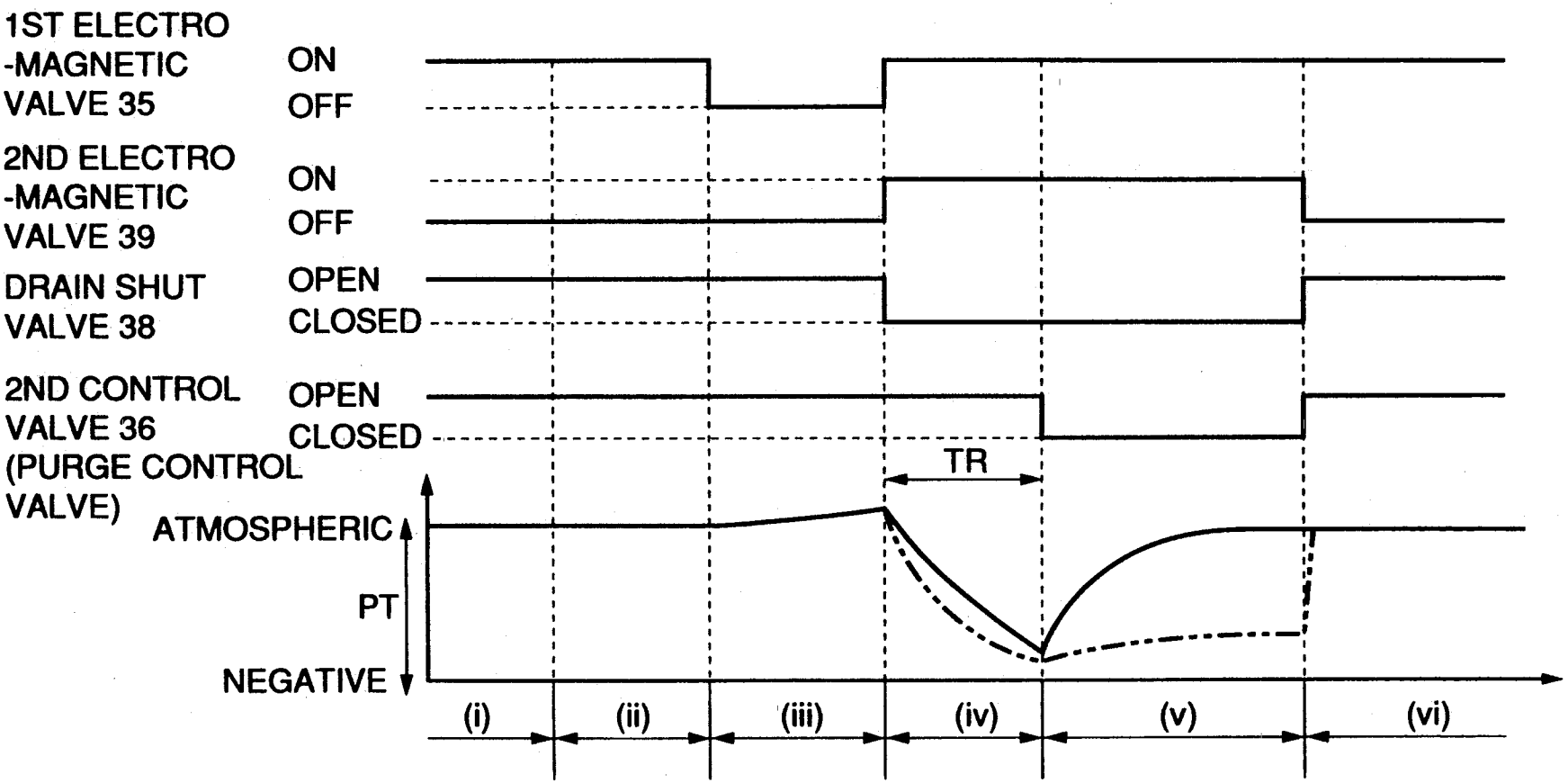
FIG. 6 is a timing chart showing operating patterns of first and second electromagnetic valves, a drain shut valve, and a purge control valve.

First, during normal operation (normal purging) of the engine, as indicated by (i) in FIG. 6, the first electromagnetic valve 35 is energized and at the same time the second electromagnetic valve 39 is deenergized. When the ignition switch IGSW is closed and the engine is detected to be operating by the IGSW sensor 18, the purge control valve 36 is energized to open. Then, evaporative fuel generated within the fuel tank 23 is allowed to flow through the evaporative fuel-guiding passage 27 into the canister 26 to be temporarily adsorbed by the adsorbent 24. Since the second electromagnetic valve 39 is deenergized during normal operation as mentioned above, the drain shut valve 38 is open to allow fresh air to be introduced into the canister 26 through the air inlet port 45*a* so that evaporative fuel flowing into and stored in the canister 26 is purged together with fresh air through the second control valve 36 into the purging passage 10. On this occasion, if the fuel tank 23 is cooled due to ambient air, etc., negative pressure is developed within the fuel tank 23, which causes the negative pressure valve 33 of the two-way valve 34 to be opened so that part of the evaporative fuel in the canister 26 is returned through the two-way valve 34 into the fuel tank 23.

When predetermined monitoring or abnormality determining conditions are satisfied, hereinafter referred to, the first and second electromagnetic valves 35, 39, and the purge control valve 36 are operated in the following manner to carry out an abnormality diagnosis of the evaporative emission control system 11.

First, the tank internal pressure PT is relieved to the atmosphere, over a time period indicated by (ii) in FIG. 6. More specifically, the first electromagnetic valve 35 is held in the energized state to maintain communication between the fuel tank 23 and the canister 26, and at the same time the second electromagnetic valve 39 is held in the deenergized state to keep the drain shut valve 38 open. Further, the purge control valve 36 is held in the energized state or opened, to relieve the tank internal pressure PT to the atmosphere.

Then, an amount of change in the tank internal pressure PT is measured over a time period indicated by (iii) in FIG. 6.

More specifically, the second electromagnetic valve 39 is held in the deenergized state to keep the drain shut valve 38 open, and at the same time the purge control valve 36 is kept open. However, the first electromagnetic valve 35 is turned off into the deenergized state, to thereby measure an amount of change in the tank internal pressure PT occurring after the interior of the fuel tank 23 has ceased to be open to the atmosphere for the purpose of checking an amount of evaporative fuel generated in the fuel tank 23.

Then, the evaporative emission control system 11 is negatively pressurized over a time period indicated by (iv) in FIG. 6. More specifically, the first electromagnetic valve 35 and the purge control valve 36 are held in the energized state, while the second electromagnetic valve 39 is turned on to close the drain shut valve 38, whereby the evaporative emission control system 11 is negatively pressurized by a gas drawing force developed by negative pressure in the purging passage 10 held in communication with the intake pipe 2. In FIG. 6, symbol TR represents the negative pressurization time period.

Then, a leak down check is carried out over a time period indicated by (v) in FIG. 6.

More specifically, after the evaporative emission control system 11 is negatively pressurized to a predetermined degree, i.e. after the predetermined negatively-pressurized condition of the system is established, the purge control valve 36 is closed, and then a change in the tank internal pressure PT occurring thereafter is checked by the PT sensor 29. If the system 11 does not suffer from a significant leak of evaporative fuel therefrom, and hence the result of the leak down check shows that there is no substantial change in the tank internal pressure PT as indicated by the two-dot-chain line in the figure, it is determined that the evaporative emission control system 11 is normal, whereas if the system 11 suffers from a significant leak of evaporative fuel therefrom, and hence the result of the leak down check shows that there is a significant change in the tank internal pressure PT toward the atmospheric pressure, as indicated by the solid line, it is determined that the system 11 is abnormal. In this connection, if the evaporative emission control system 11 cannot be brought into the predetermined negatively pressurized condition within a predetermined time period, the leak down check is not carried out, as described hereinafter.

After determining whether or not the system 11 is abnormal, the system 11 returns to the normal purging mode, as indicated by (vi) in FIG. 6.

More specifically, while the first electromagnetic valve 35 is held in the energized state, the second electromagnetic valve 39 is deenergized and the purge control valve 36 is opened, to thereby perform normal purging of evaporative fuel. In this state, the tank internal pressure PT is relieved to the atmosphere, and hence it is substantially equal to the atmospheric pressure.

Next, the manner of abnormality diagnosis of the evaporative emission control system 11 will be described with reference to FIGS. 7 to 18.

Figure 7A:
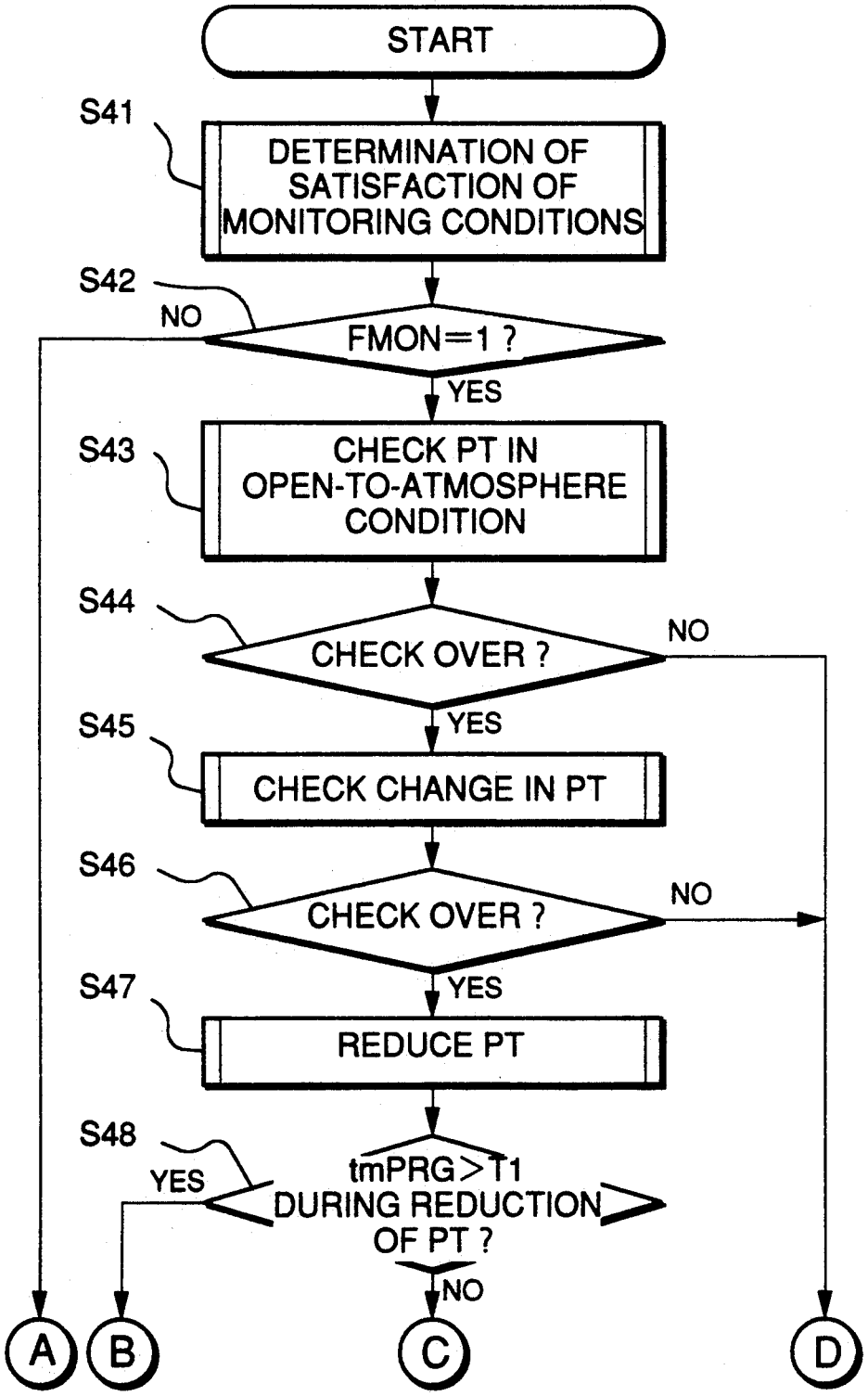
FIG. 7 is a flowchart showing a main routine for determining abnormality in the evaporative emission control system of the engine.
Figure 7B:
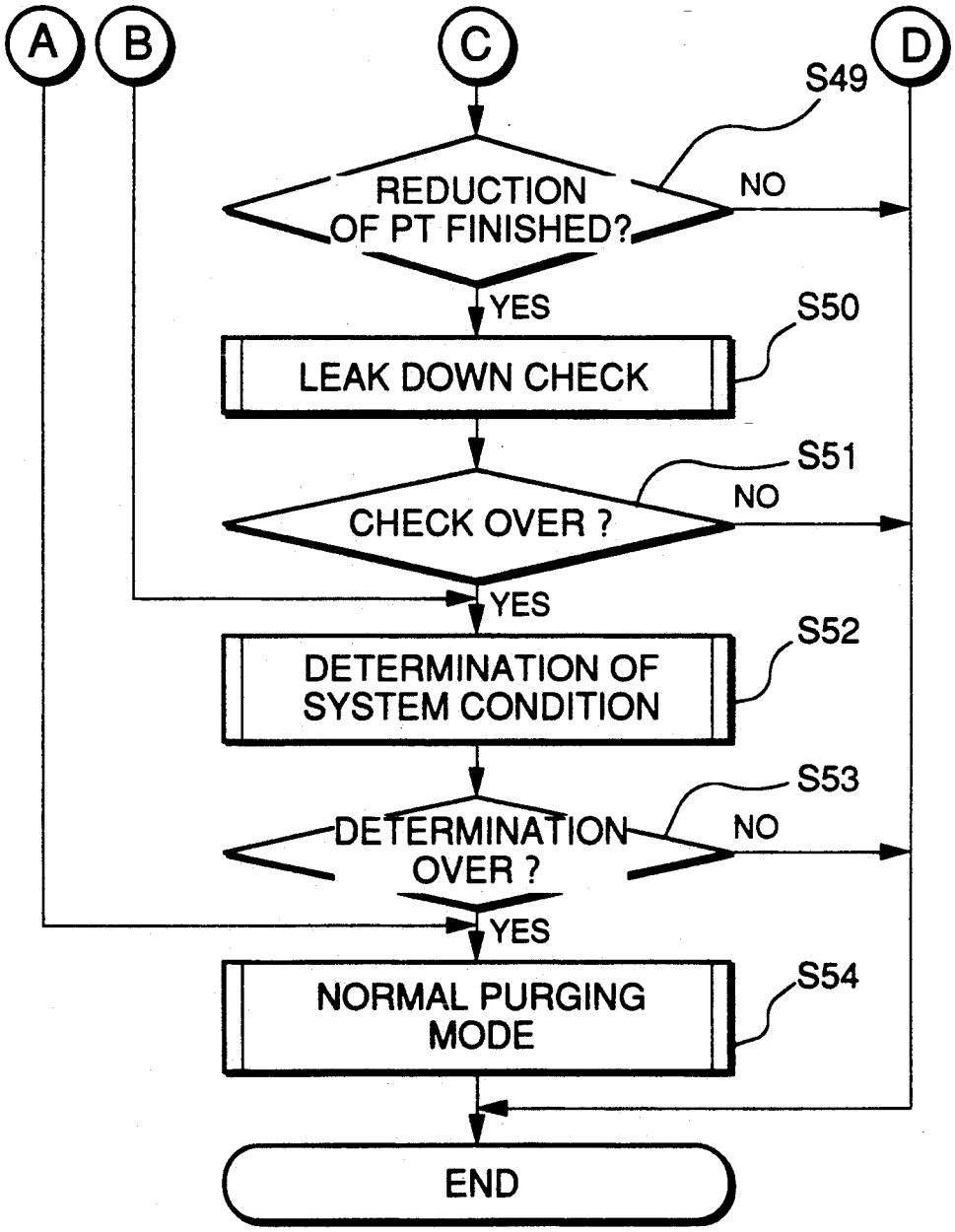

FIG. 7 shows a program for carrying out the abnormality diagnosis of the evaporative emission control system 11, which is executed by the CPU of the ECU 5.

First, at a step S41, a routine of determining permission for monitoring (abnormality determination) is carried out, as described hereinafter. Then, at a step S42, it is determined whether or not the monitoring of the system 11 for abnormality diagnosis is permitted, i.e. a flag FMON is set to "1". If the answer to this question is negative (NO), the first to third control valves 28, 36, 40 are set to respective operative states for normal purging mode of the system, followed by terminating the program, whereas if the answer to this question is affirmative (YES), the tank internal pressure PT in the open-to-atmosphere condition of the system is checked at a step S43, and it is determined at a step S44 whether or not this check has been completed. If the answer to this question is negative (NO), the program is immediately terminated, whereas if it is affirmative (YES), the first electromagnetic valve 35 is turned off to check a change in the tank internal pressure PT at a step S45, followed by determining at a step S46 whether or not this check has been completed. If the answer to this question is negative (NO), the program is immediately terminated, whereas if it is affirmative (YES), the first to third control valves 28, 36, 40 are operated at a step S47 to establish the negatively pressurized condition of the evaporative emission control system 11 and the fuel tank 23.

Simultaneously with the start of the negative pressurization at the step S47, a first timer tmPRG incorporated in the ECU 5 is started, and it is determined at a step S48 whether or not the count value thereof is larger than a value corresponding to a predetermined time period T1. The predetermined time period T1 is set to such a value as ensures that the system 11 is negatively pressurized to a predetermined pressure value, i.e. the negatively pressurized condition of the system 11 is established within the predetermined time period T1, if the system is normal. If the answer to the question of the step S48 is affirmative (YES), it is determined that the system 11 cannot be negatively pressurized to the predetermined pressure value due to a hole formed in the fuel tank 23, etc., the program proceeds to a step S52. On the other hand, if the answer to the question of the step S48 is negative (NO), it is determined at a step S49 whether or not the negative pressurization has been completed, i.e. the negatively pressurized condition of the system 11 is established. If the answer to this question is negative (NO), the program is immediately terminated, whereas if it is affirmative (YES), a leak down check routine, described in detail hereinafter, is carried out at a step S50 to check whether or not the system 11 is properly sealed, i.e. it is free from a leak of evaporative fuel therefrom in the normal operating mode thereof. Then, at a step S51, it is determined whether or not this check has been completed.

If the answer to this question is negative (NO), the program is immediately terminated, whereas if the answer is affirmative (YES), the program proceeds to the step S52.

At the step S52, it is determined whether or not the system 11 is in a normal condition, followed by determining at a step S53 whether the determination of the step S52 has been completed. If the answer to this question is negative (NO), the program is immediately terminated, whereas if it is affirmative (YES), the system 11 is set to the normal purging mode at a step S54, followed by terminating the program.

Next, the above steps will be described in detail hereinbelow:

(1) Determination of Permission for Monitoring (at the step S41 of FIG. 7)

Figure 8:
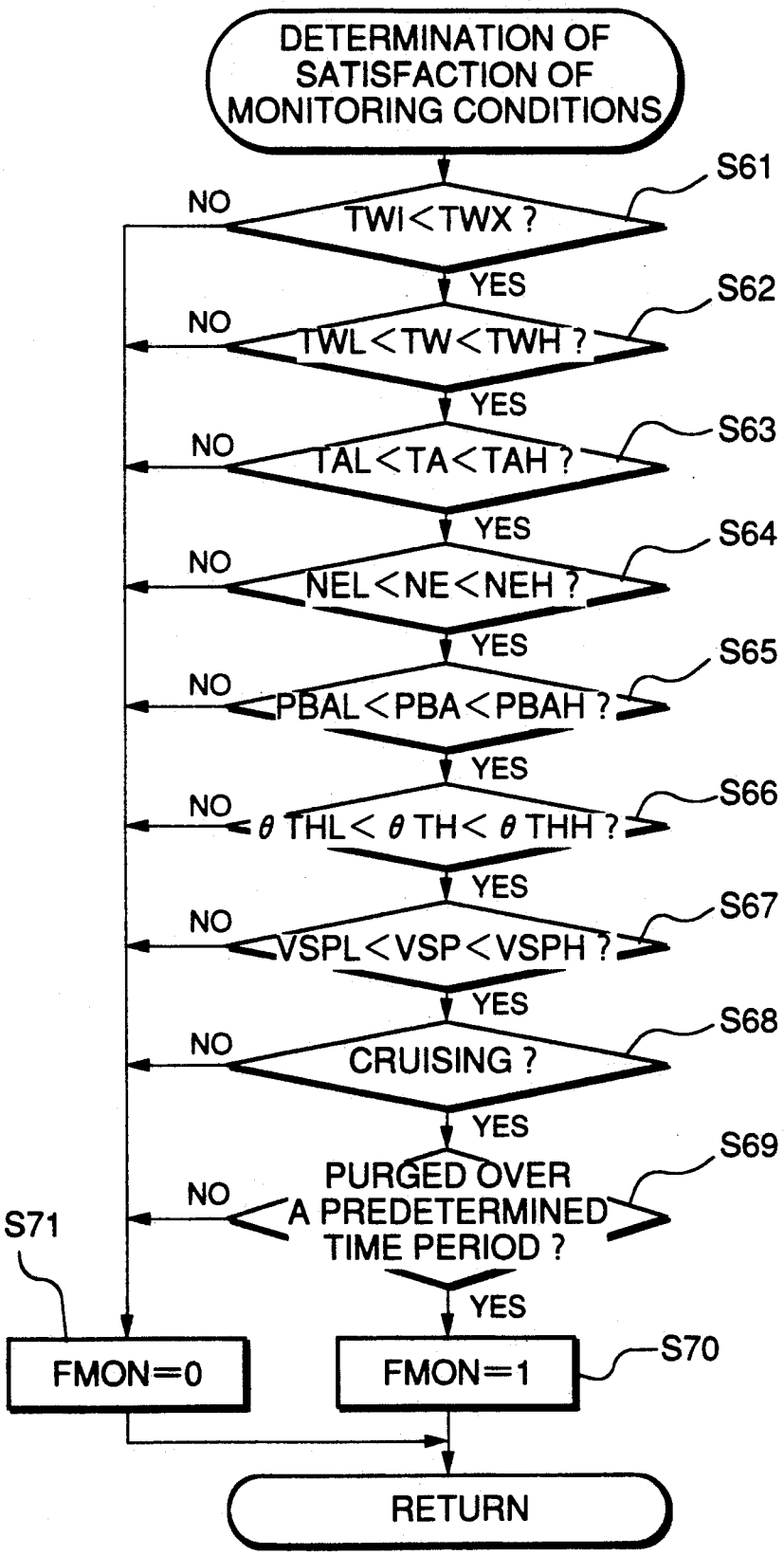
FIG. 8 is a flowchart showing a routine for determining fulfillment of abnormality determining conditions.

FIG. 8 shows a routine for determining whether or not monitoring of the system 11 for abnormality diagnosis thereof is permitted. This routine is executed as a background processing.

At a step S61, it is determined whether or not the engine coolant temperature TW detected at the start of the engine 1 is lower than a predetermined value TWX. The abnormality diagnosis of the present embodiment has only to be carried out only after the engine has been out of operation for a long time period (e.g. once per day). First, when the ignition switch IGSW is closed, the engine coolant temperature TW is detected at the start of the engine and read in, and it is determined at the step S61 in the present routine whether or not the engine coolant temperature TW is lower than the predetermined value TWX, e.g. 20° C. If the answer to this question is affirmative (YES), i.e. if the engine coolant temperature TW detected at the start of the engine is lower than the predetermined value TWX, the program proceeds to a step S62, wherein it is determined whether or not the engine coolant temperature TW detected by the TW sensor 15 falls between a predetermined lower limit value TWL (e.g. 50° C.) and a predetermined higher limit value TWH (e.g. 90° C.) If the answer to this question is affirmative (YES), it is determined at a step S63 whether or not the intake air temperature TA detected by the TA sensor 14 falls between a predetermined lower limit value TAL (e.g. 70° C.) and a predetermined higher limit value TAH (e.g. 90° C.). If the answer to this question is affirmative (YES), it is determined that the engine 1 is being warmed up, and then the program proceeds to a step S64.

At the step S64, it is determined whether or not the engine rotational speed NE detected by the NE sensor 16 falls between a predetermined lower limit value NEL (e.g. 2000 rpm) and a predetermined higher limit value NEH (e.g. 4000 rpm). If the answer to this question is affirmative (YES), it is determined at a step S65 whether or not the intake pipe absolute pressure PBA detected by the PBA sensor 13 falls between a predetermined lower limit value PBAL (e.g. 350 mmhg) and a predetermined higher limit value PBAH (e.g. −150 mmhg). If the answer to this question is affirmative (YES), it is determined at a step S66 whether or not the throttle valve opening θTH detected by the θTH sensor 4 falls between a predetermined lower limit value θTHL (e.g. 1°) and a predetermined higher limit value θTHH (e.g. 5°). If the answer to this question is affirmative (YES), it is determined at a step S67 whether or not the vehicle speed VSP detected by the VSP sensor 21 falls between a predetermined lower limit value VSPL (e.g. 53 km/hr) and a predetermined higher limit value VSPH (e.g. 61 km/hr). If the answer to this question is affirmative (YES), it is determined that the engine 1 is being warmed up and stable in operation, and then the program proceeds to a step S68. At the step S68, it is determined whether or not the vehicle is cruising. This determination is made by determining whether or not a variation in the vehicle speed has continuously been within a range of ± 0.8 km/sec over a predetermined time period (e.g. 2 sec). If the answer to this question is affirmative (YES), it is determined at a step S69 whether or not purging of evaporative fuel has been carried out over a predetermined time period. More specifically, in the case where a large amount of evaporative fuel is stored in the canister 26, it takes a longer time period to establish the negatively pressurized condition of the system 11 due to the resulting large resistance of the canister 26 to permeation of gases, or there is a fear that undesirably rich evaporative fuel is purged into the intake system during the negative pressurization. Therefore, in the present embodiment, monitoring of the evaporative emission control system 11 is carried out only after the purging of evaporative fuel has been carried over the predetermined time period, to reduce the amount of evaporative fuel adsorbed and stored in the canister 26.

If the answer to the question of the step S69 is affirmative (YES), the flag FMON is set to "1" at a step S70 for permitting monitoring of the system 11 for abnormality diagnosis, followed by terminating the program. On the other hand, if at least one of the answers to the questions of the steps S61 to S70 is negative (NO), the conditions for permitting monitoring are not satisfied, so that the flag FMON is set to "0" at a step S71, followed by terminating the program.

(2) Check of Tank Internal Pressure in Open-to-Atmosphere Condition (at the step S43 in FIG. 7)

Figure 9:
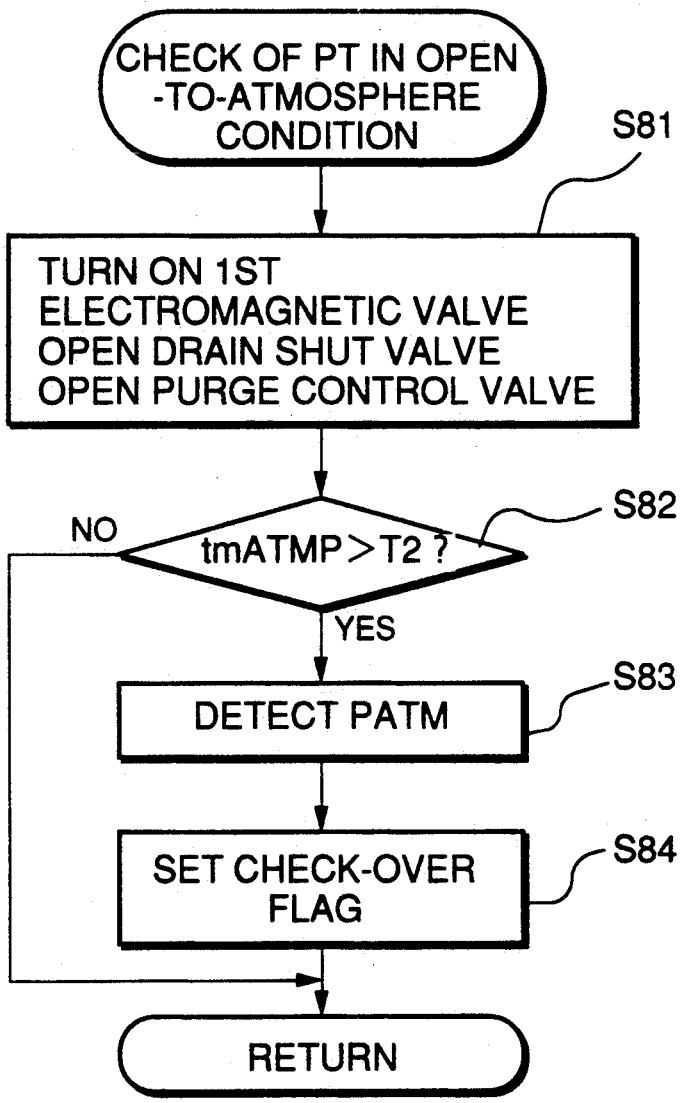
FIG. 9 is a flowchart showing a routine for checking pressure within a fuel tank in FIG. 1 (tank internal pressure) when the interior of the fuel tank is open to the atmosphere.
Figure 10:
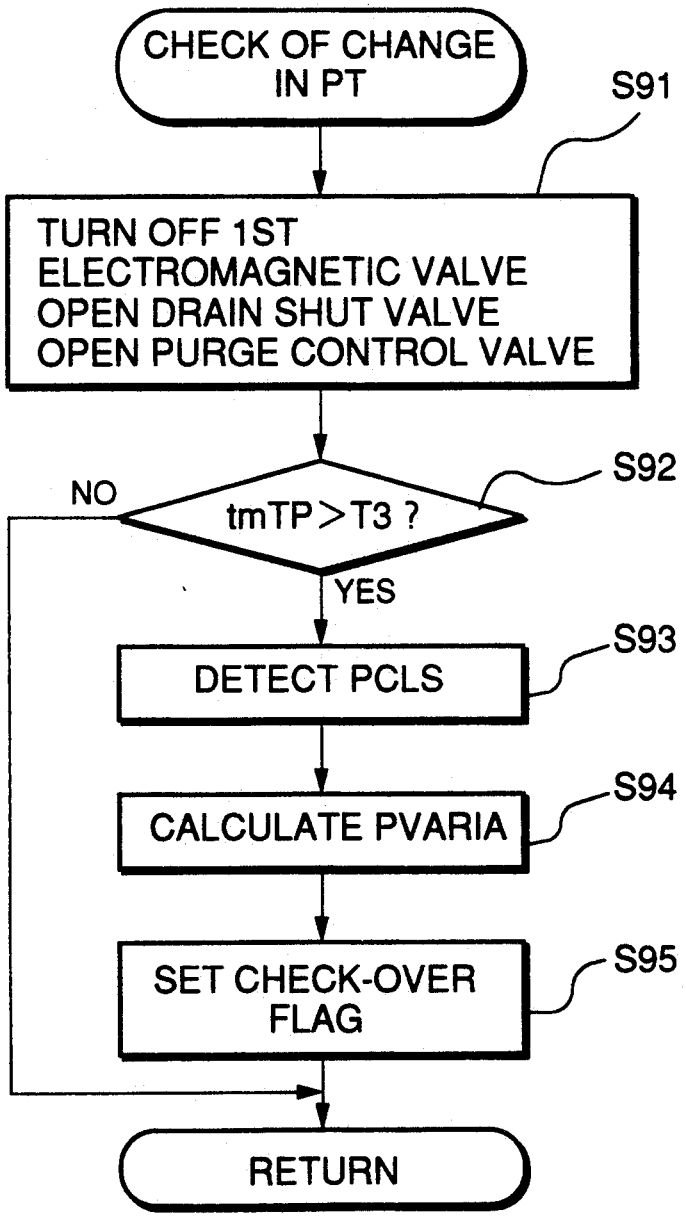
FIG. 10 is a flowchart showing a routine for checking changes in the tank internal pressure.

FIG. 9 shows a routine for carrying out the tank internal pressure check in the open-to-atmosphere condition, which is also executed as a background processing.

First, at a step S81, the system 11 is set to the open-to-atmosphere mode, and at the same time, a second timer tmATMP is reset and started. More specifically, the first electromagnetic valve 35 is held in the energized state, and at the same time the second electromagnetic valve 39 is held in the deenergized state to keep the drain shut valve 38 open. Further, the purge control valve 36 is kept open. Thus, the tank internal pressure PT is relieved to the atmosphere (see the time period indicated by (ii) in FIG. 6).

Then, at a step S82, it is determined whether or not the count value of the second timer tmATMP is larger than a value corresponding to a predetermined time period T2. The predetermined time period T2 is set to a value, e.g. 4 sec, which ensures that the pressure within the system 11 has been stabilized upon lapse thereof. If the answer to this question is negative (NO), the program is immediately terminated, while if it is affirmative (YES), the program proceeds to a step S83, where the tank internal pressure PATM in the open-to-atmosphere condition is detected by the PT sensor 29 and stored into the ECU 5, and then a check-over flag is set at a step S84, followed by terminating the program.

(3) Check of A Change in Tank Internal Pressure (at the step S45 in FIG. 7)

FIG. 7 shows a routine for checking a change in the tank internal pressure, which is executed as a background processing.

First, at a step S91, the system 11 is set to a PT change-checking mode, and at the same time a third timer tmTP is reset and started. More specifically, while the purge control valve 36 and the drain shut valve 38 are held open, the first electromagnetic valve 35 is turned off to thereby set the system to the PT change checking mode (see the time period indicated by (iii) in FIG. 6).

Then, at a step S92, it is determined whether or not the count value of the third timer tmTP is larger than a value corresponding to a third predetermined time period T3, e.g. 10 sec. If the answer to this question is negative (NO), the program is immediately terminated, whereas if it is affirmative (YES), the tank internal pressure PCLS after the lapse of the predetermined time period T3 is detected and stored into the ECU 5 at a step S93, followed by calculation of a first rate of change PVARIA in the tank internal pressure at a step S94 by the use of the following equation (1)

$$PVARIA=(PCLS-PATM)/T3 \quad (1)$$

Then, the first rate of change PVARIA thus calculated is stored into the ECU 5 and a check-over flag is set at a step S95, followed by terminating the program.

(4) Negative Pressurization (at the step S47 in FIG. 7)

Figure 11:
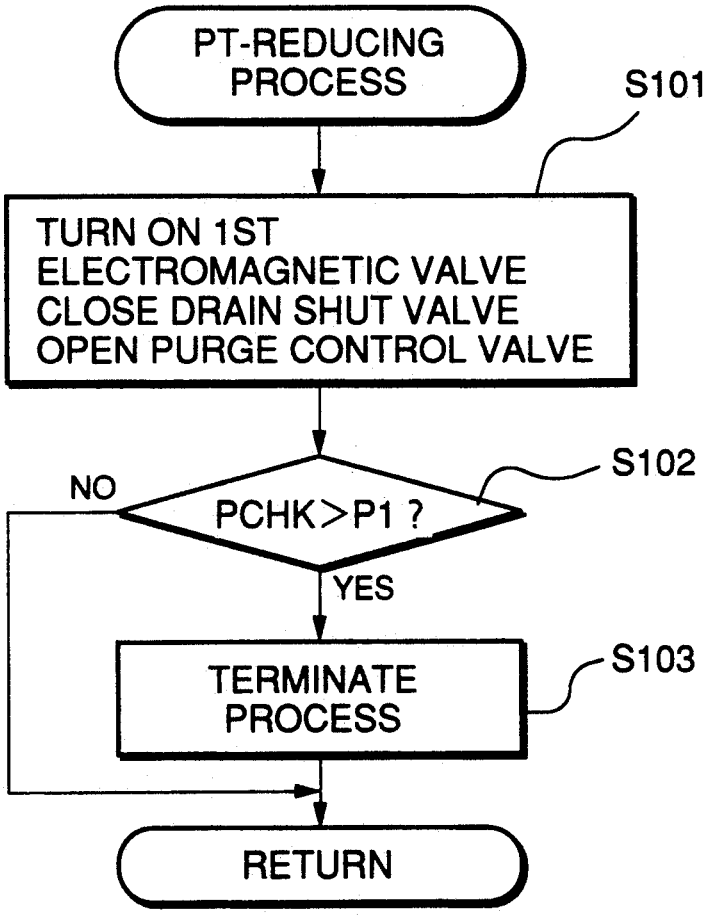
FIG. 11 is a flowchart showing a routine for reducing the tank internal pressure.

FIG. 11 shows a routine for carrying out a process of negatively pressurizing the system 11 to establish the negatively-pressurized condition of the system, which is executed as a background processing.

First, at a step S101, the system 11 is set to a negatively-pressurizing mode. More specifically, the purge control valve 36 is kept open, and at the same time the first electromagnetic valve 35 is turned on, and the second electromagnetic valve 39 is turned on to close the drain shut valve 38 (see the time period indicated by (iv) in FIG. 6). In this state, the system 11 is negatively pressurized to a predetermined value by a gas-drawing force created by operation of the engine 1. Then, it is determined at a step S102 whether or not the tank internal pressure PCHK in this mode of the system 11 is lower than a predetermined value P1 (e.g. −20 mmhg). If the answer to this question is negative (NO), the program is immediately terminated, whereas if it becomes affirmative (YES), a process-over flag is set at a step S103, followed by terminating the program.

(5) Leak Down Check (at the step S50 in FIG. 7)

Figure 12:
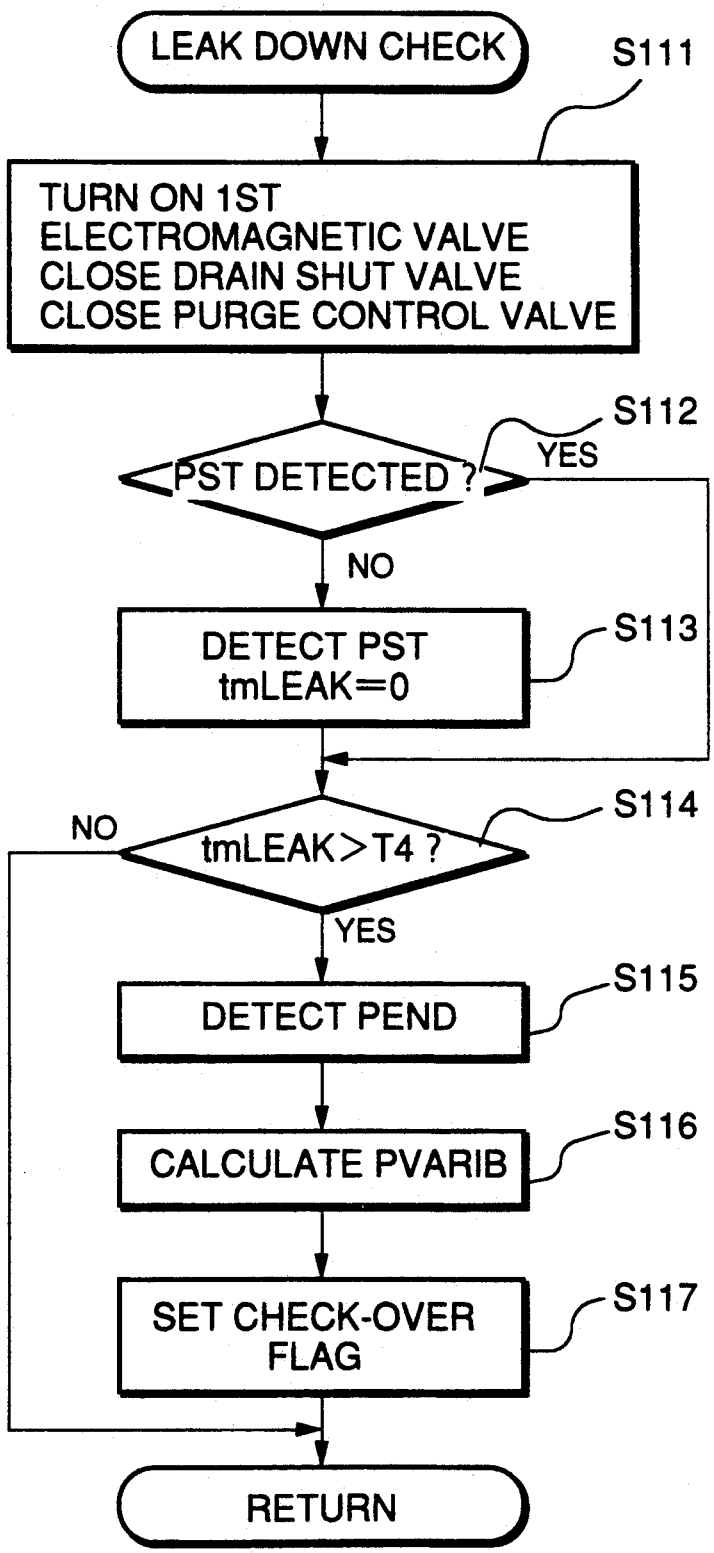
FIG. 12 is a flowchart showing a leak down check routine for checking a change rate in the tank internal pressure when the evaporative emission control system is isolated from the intake pipe.

FIG. 12 shows a routine for performing a leak down check of the system 11, which is executed as a background processing.

First, at a step S111, the system 11 is set to a leak down check mode. More specifically, while the first electromagnetic valve 35 is held in the energized state, and at the same time the drain shut valve 38 is kept closed, the purge control valve 36 is closed to cut off the communication between the system 11 and the intake pipe 2 of the engine 1 (see the time period (v) in FIG. 6).

Then, the program proceeds to a step S112, wherein it is determined whether or not the tank internal pressure PST at the start of the leak down check has been detected. In the first execution of this step S112, the answer to this question is negative (NO), so that the program proceeds to a step S113, wherein the tank internal pressure PST is detected and a fourth timer tmLEAK is reset and started.

Then, it is determined at a step S114 whether the count value of the fourth timer tmLEAK is larger than a value corresponding to a fourth predetermined time period T4 (e.g. 10 sec.). In the first execution of this step S114, the answer to this question is negative (NO), so that the program is immediately terminated.

In the following loop, the answer to the question of the step S112 becomes affirmative (YES), so that the program jumps over to the step S114, wherein it is determined whether or not the count value of the fourth timer tmLEAK is larger than the value corresponding to the predetermined time period T4. if the answer to this question is negative (NO), the program is immediately terminated, whereas if it becomes affirmative (YES), the present tank internal pressure i.e. the tank internal pressure PEND at the end of the leak down check is detected and stored into the memory means of the ECU 5 at a step S115, followed by calculation of a second rate of change PVARIB in the tank internal pressure PT at a step S116 by the use of the following equation (2):

$$PVARIB=(PEND-PST)/T4 \quad (2)$$

The second rate of change PVARIB in the tank internal pressure PT thus calculated is stored into the memory means of the ECU 5, and a check-over flag is set at a step S117, followed by terminating the program.

(6) System Condition-Determining Process (at the step S52 in FIG. 7)

Figure 13:
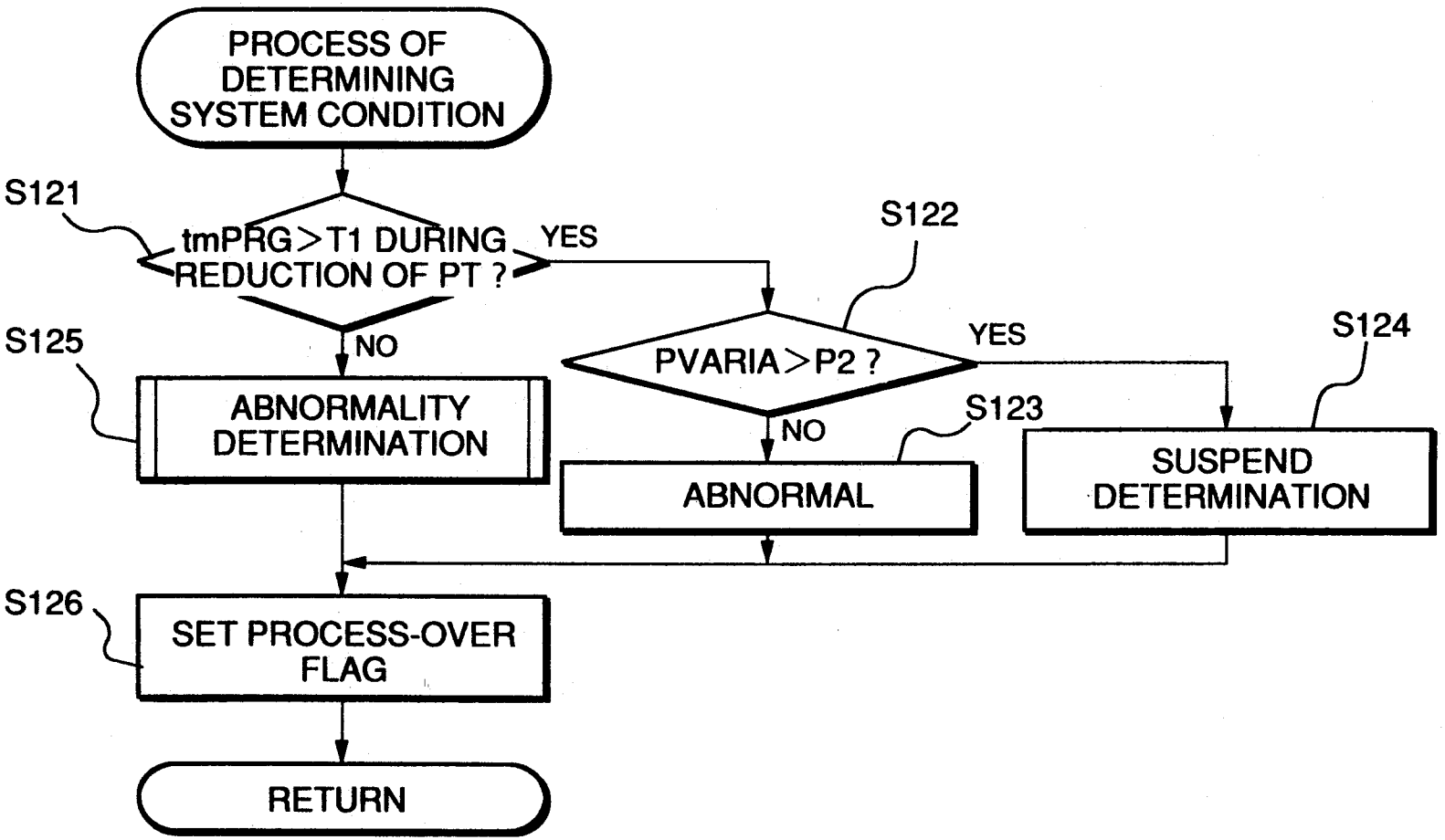
FIG. 13 is a flowchart showing a routine for determining a condition of the evaporative emission control system.

FIG. 13 shows a routine for carrying out a process of determining a condition of the system 11, which is executed as a background processing.

First, at a step S121, it is determined whether or not the count value of the first timer tmPRG exceeded the value corresponding to the predetermined value T1 during the negatively-pressurizing process. If the answer to this question is affirmative (YES), it is determined that the system 11 may suffer from a significant leak of evaporative fuel due to a hole formed in the fuel tank 23, etc., so that the program proceeds to a step S122, where it is determined whether or not the first rate of change PVARIA in the tank internal pressure PT is larger than a predetermined value P2. If the answer to this question is negative (NO), which means that evaporative fuel was not generated at a large rate in the fuel tank 23 so that the predetermined negatively pressurized condition of the system 11 could have been properly established in the negatively-pressurizing process if the system 11 had been in a normal condition, it is determined that the system 11 suffers from a significant leak of evaporative fuel from the fuel tank 23, piping connections, etc., determining that the evaporative emission control system 11 is abnormal (step S123), and then a process-over flag is set at a step S126, followed by terminating the program. On the other hand, if the answer to the question of the step S122 is affirmative (YES), which means that evaporative fuel was generated at a large rate in the fuel tank 23 to increase the tank internal pressure PT, which prevented the system 11 from being negatively pressurized in a proper manner in the negatively-pressurizing process, the determination of the system condition is suspended at a step S124, and then the process-over flag is set at the step S126, followed by terminating the program.

On the other hand, if the answer to the question of the step S121 is negative (NO), i.e. if the system 11 was negatively pressurized to the predetermined value, an abnormality-determining routine is carried out at a step S125, and then the process-over flag is set at the step S126, followed by terminating the program.

Figure 14:
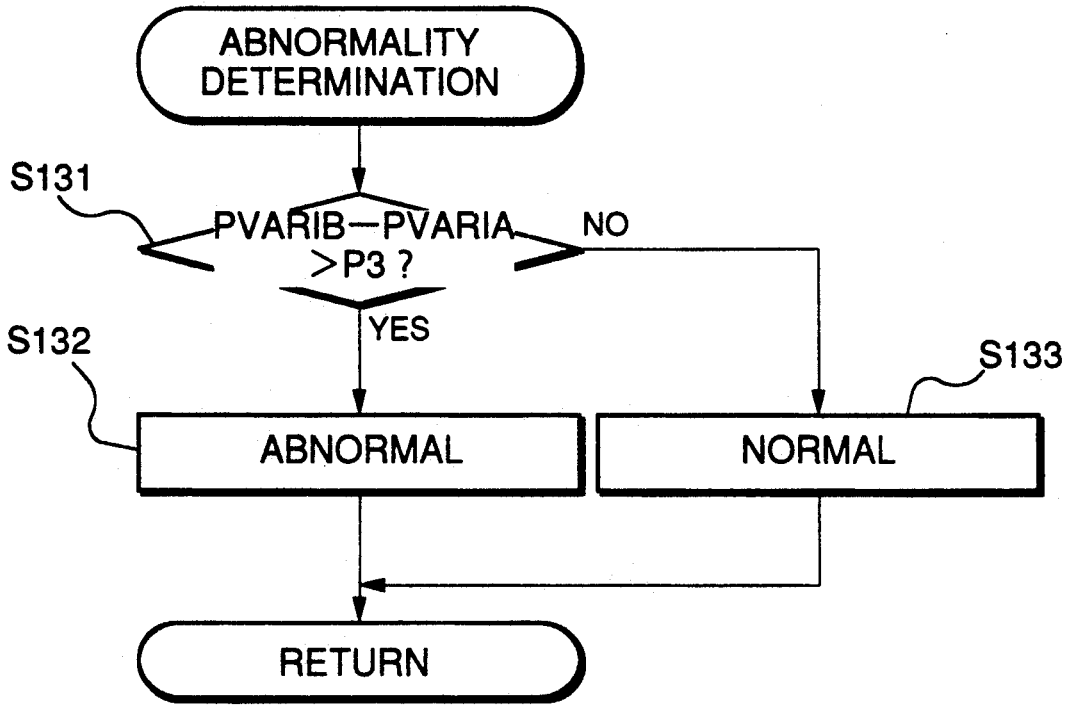
FIG. 14 is a flowchart showing a routine for determining abnormality in the system.

The abnormality-determining routine carried out at the step S125 is shown by way of example in FIG. 14.

First, it is determined at a step S131 whether or not the difference between the second change of rate PVARIB in the tank internal pressure PT and the first rate of change PVARIA in the same is larger than a predetermined value P3.

Figure 15:
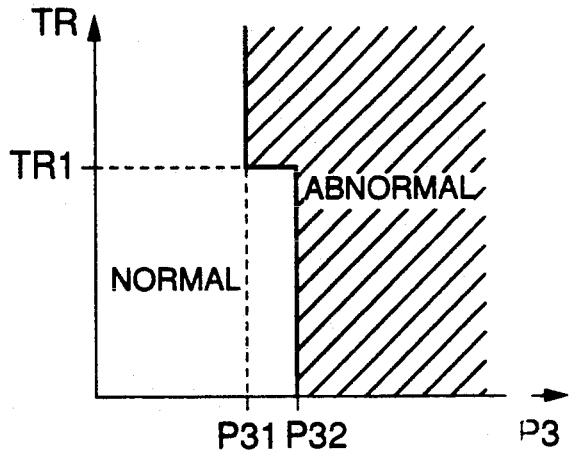
FIG. 15 shows a map used by the routine of FIG. 11.

More specifically, in order to determine whether a main factor which has determined the rate of change PVARIB in the tank internal pressure PT is faulty sealing of the system 11, which means that there occurs a significant leak of evaporative fuel from the system 11 in the normal operating mode thereof, or generation of evaporative fuel from the fuel tank 23, it is determined whether or not the difference between the second rate of change PVARIB and the first rate of change PVARIA is larger than the predetermined value P3. If the second rate of change PVARIB assumes a large value due to generation of a large amount of evaporative fuel from the fuel tank 23, the answer to the question of the step S131 is negative (NO), whereas if the second rate of change PVARIB assumes a large value due to the faulty sealing of the system 11, the answer is affirmative (YES). The predetermined value P3 is set according to the time period TR required for establishing the negatively pressurized condition of the system 11 in a manner as shown in FIG. 15. More specifically, the predetermined value P3 is set to a value P31 when the time period TR is longer than a predetermined value TR1, whereas it is set to a value P32 (>P31) when the time period TR is shorter than the predetermined value.

If the answer to the question of the step S131 is affirmative (YES), it is determined at a step S132 that the evaporative emission control system 11 is abnormal, whereas if the answer is negative (NO), it is determined at a step S133 that the system 11 is normal, followed by terminating the program.

Figure 16:
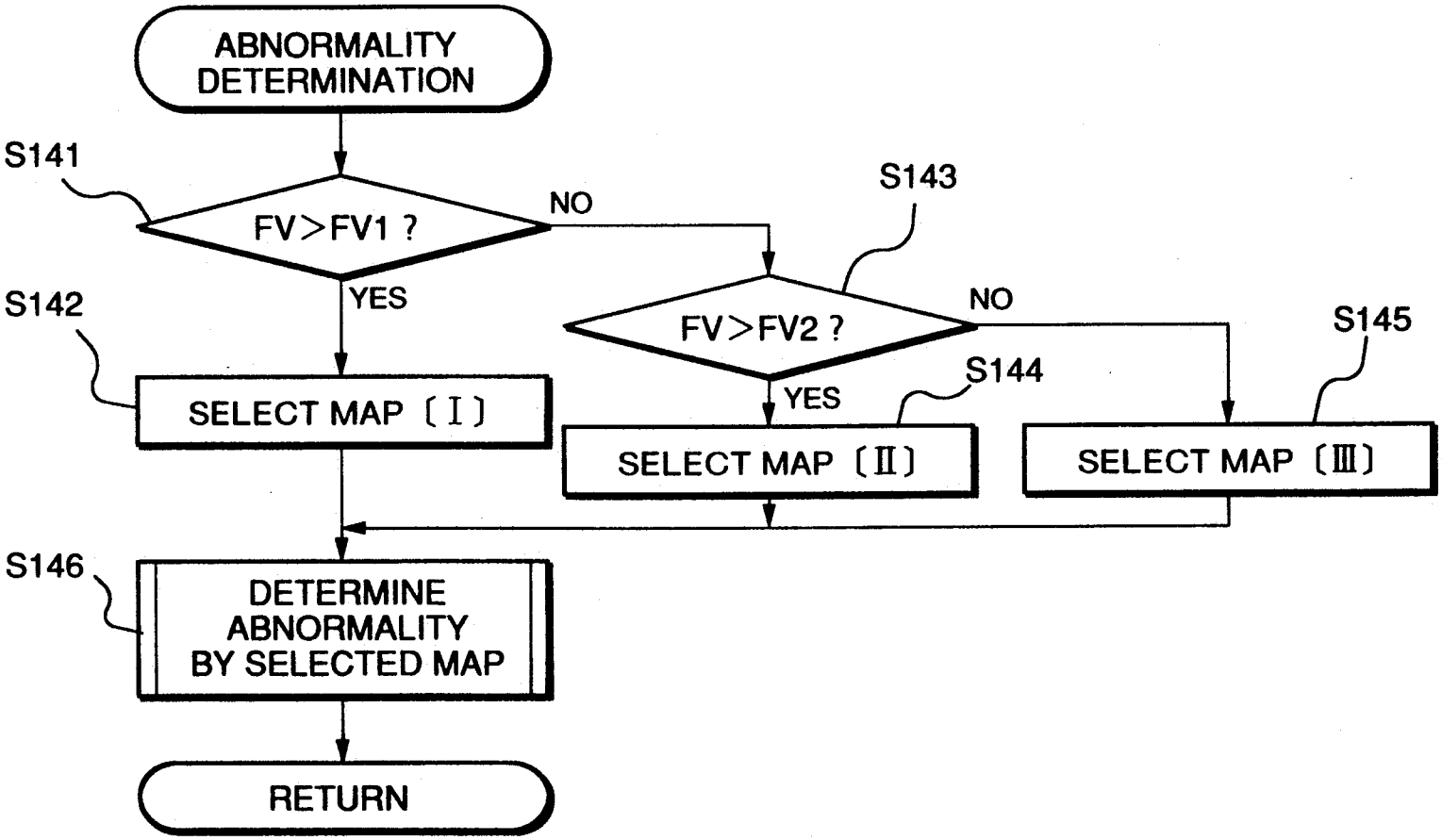
FIG. 16 is a flowchart showing a routine for determining abnormality in the system according to another embodiment of the invention.

FIG. 16 shows another example of the abnormality determining routine.

First, at a step S141, it is determined whether or not the fuel amount FV in the fuel tank 23 detected by the FV sensor 30 is larger than a first predetermined value, to determine whether or not the fuel tank 23 is substantially fully filled with fuel. If the answer to this question is affirmative (YES), a map [I] is selected at a step S142, whereas if the answer is negative (NO), it is determined at a step S143 whether or not the fuel amount FV is larger than a second predetermined value FV2, to determine whether or not the fuel tank 23 is filled half or more with fuel. If the answer to this question is affirmative (YES), a map [II] is selected at a step S144, whereas if the answer is negative (NO), a map [III]is selected at a step S145.

Then, the abnormality determination is carried out at a step S146 by the use of a selected one of the maps [I] to [III], followed by terminating the program.

Figure 17A:
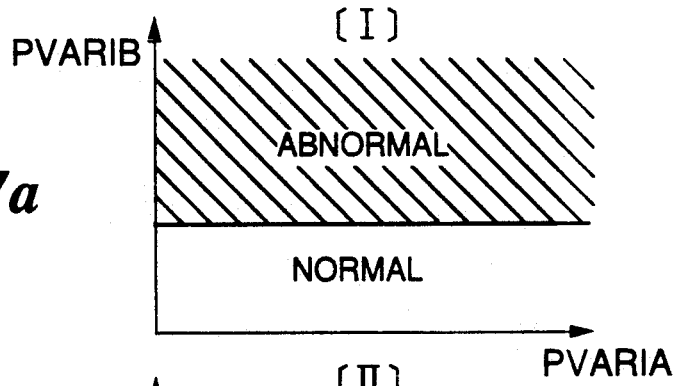
FIG. 17*a* to FIG. 17*c* show maps used by the routine of FIG. 13, respectively.
Figure 17B:
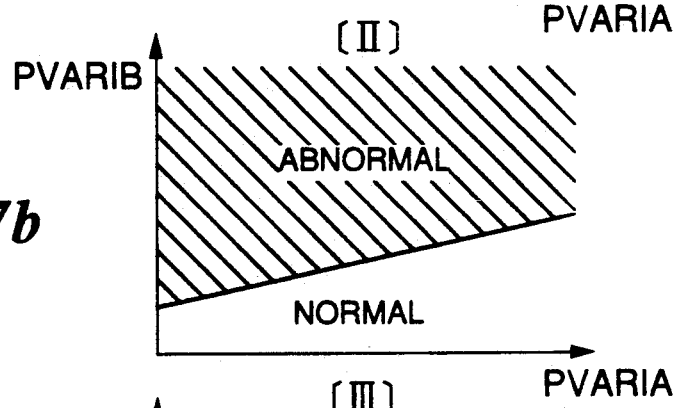
Figure 17C:
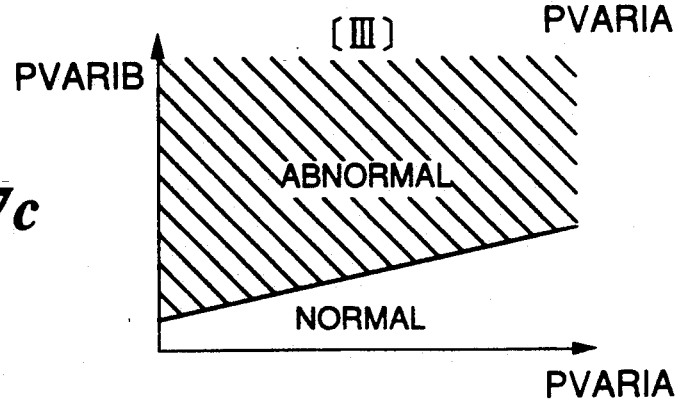

More specifically, as shown in FIG. 17*a* to FIG. 17*c*, the maps [I] to [III] are each set such that a normal region and an abnormal region are defined in a manner depending on the relationship between the first rate of change PVARIA in the tank internal pressure PT and the second rate of change PVARIB in the tank internal pressure PT. By retrieving the selected one of the maps, it is determined whether or not the system 11 is normal. In the figures, the hatched sections indicate the abnormal regions.

(7) Normal Purging (at the step S54 in FIG. 7)

Figure 18:
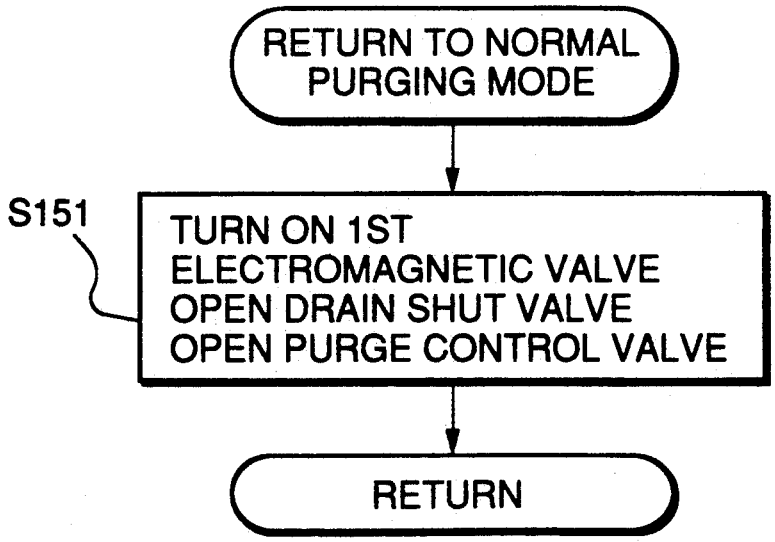
FIG. 18 is a flowchart showing a routine for carrying out normal purging.

FIG. 18 shows a routine for restoring the normal purging mode of the system 11, in which the operative states of the valves are specified.

More specifically, the first electromagnetic valve 35 is held in the energized state and the drain shut valve 39 and the purge control valve 36 are opened to thereby set the system to the normal purging mode, at a step S151, followed by terminating the program.

What is claimed is:

1. A failure-detecting device for a tank internal pressure sensor for an internal combustion engine having a fuel tank, an intake system, and an evaporative emission control system for controlling purging of evaporative fuel generated in said fuel tank into the intake system, said tank internal pressure sensor being provided in said fuel tank for detecting pressure within said fuel tank, comprising:

output variation-detecting means for detecting an amount of variation in an output from said tank internal pressure sensor occurring within a predetermined time period after the start of said engine; and determining means for determining that said tank internal pressure sensor is abnormal when said amount of variation is below a predetermined value upon the lapse of said predetermined time period.

2. A failure-detecting device according to claim 1, wherein said evaporative emission control system includes a canister, a passage connecting said fuel tank with said canister, and a valve arranged across said passage for controlling communication between said fuel tank and said canister, said valve being opened before said amount of variation in said output from said tank internal pressure sensor is detected, said output variation detecting means detecting said amount of variation in said output from said tank internal pressure sensor after said valve has been closed.

3. A failure-detecting device according to claim 1, wherein said output variation-detecting means comprises first detecting means for detecting a value of said output from said tank internal pressure sensor immediately before a second predetermined time period, which is shorter than said first-mentioned predetermined time period, elapses after the start of said engine, second detecting means for detecting a present value of said output from said tank internal pressure sensor after said second predetermined time period has elapsed and before said first-mentioned predetermined time period elapses, and variation-calculating means for calculating as said amount of variation a difference between said value of said output from said tank internal pressure sensor detected by said first detecting means and said present value thereof detected by said second detecting means.

4. A failure-detecting device according to the claim 1, including means for relieving the pressure within said fuel tank to the atmospheric pressure before detecting said amount of variation in said output from said tank internal pressure sensor is detected.

5. A failure-detecting device according to claim 1, including abnormality kind-determining means for determining a kind of said failure of said tank internal pressure sensor, based on said value of said output detected upon the lapse of said predetermined time period elapses.

6. A failure-detecting device according to claim 2, including abnormality kind-determining means for determining a kind of said failure of said tank internal pressure sensor, based on said value of said output detected upon the lapse of said predetermined time period.

7. A failure-detecting device according to claim 3, including abnormality kind-determining means for determining a kind of said failure of said tank internal pressure sensor, based on said value of said output detected upon the lapse of said predetermined time period elapses.

8. A failure-detecting device according to claim 4, including abnormality; kind-determining means for determining a kind of said failure of said tank internal pressure sensor, based on said value of said output detected upon the lapse of said predetermined time period elapses.

9. A fail-safe device for a tank internal pressure sensor for an internal combustion engine having a fuel tank, an intake system, and an evaporative emission control system for controlling purging of evaporative fuel generated in said fuel tank into the intake system, said tank internal pressure sensor being provided in said fuel tank for detecting pressure within said fuel tank, comprising:

output variation detecting means for detecting an amount of variation in an output from said tank internal pressure sensor occurring within a predetermined time period after the start of said engine;

determining means for determining that said tank internal pressure sensor is abnormal when said amount of variation is below a predetermined value upon the lapse of said predetermined time period; and inhibiting means for inhibiting abnormality diagnosis of said evaporative emission control system when said determining means determines that said tank internal pressure sensor is abnormal.

10. A fail-safe device for a tank internal pressure sensor for an internal combustion engine having a fuel tank, said tank internal pressure sensor being provided in said fuel tank for detecting pressure within said fuel tank, an intake system, and an evaporative emission control system having a canister having an air inlet port formed therein, an evaporative fuel-guiding passage extending between said fuel tank and said canister, a first control valve arranged across said evaporative fuel-guiding passage for closing and opening said passage, a purging passage extending between said canister and said intake system, a second control valve arranged across said purging passage for closing and opening said purging passage, and a third control valve arranged at said air inlet port of said canister for closing and opening said air inlet port, said fail-safe device comprising:

output variation-detecting means for detecting an amount of variation in an output from said tank internal pressure sensor occurring within a predetermined time period after the start of said engine;

determining means for determining that said tank internal pressure sensor is abnormal when said amount of variation is below a predetermined value upon the lapse of said predetermined time period; and valve control means for performing a fail-safe action including at least opening said third control valve when said determining means determines that said tank internal pressure sensor is abnormal.

* * * * *